US010343274B2

(12) United States Patent
Katz et al.

(10) Patent No.: US 10,343,274 B2
(45) Date of Patent: Jul. 9, 2019

(54) FOLDING SAWHORSE

(75) Inventors: Amir Katz, Bat-Heffer (IL); Eitan Landau, Ramat-Gan (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 957 days.

(21) Appl. No.: 12/467,147

(22) Filed: May 15, 2009

(65) Prior Publication Data

US 2010/0288585 A1 Nov. 18, 2010

(51) Int. Cl.

| | |
|---|---|
| ***E04G 1/34*** | (2006.01) |
| ***B25H 1/06*** | (2006.01) |
| ***B25H 1/04*** | (2006.01) |

(52) U.S. Cl.

CPC ..... *B25H 1/06* (2013.01); *B25H 1/04* (2013.01); *E04G 1/34* (2013.01)

(58) Field of Classification Search

CPC .... B25H 1/04; B25H 1/06; B25H 1/12; A47B 2200/0016; E04G 1/34

USPC ..... 182/155, 153, 225, 181.1

See application file for complete search history.

(56) References Cited

U.S. PATENT DOCUMENTS

| | | | | |
|---|---|---|---|---|
| 1,450,869 A | | 4/1920 | Reinelt | |
| 1,479,209 A | | 3/1922 | Topp | |
| 1,476,855 A | * | 12/1923 | Topp | 182/155 |
| 1,656,558 A | * | 1/1928 | Ross | 182/155 |

(Continued)

FOREIGN PATENT DOCUMENTS

| | | |
|---|---|---|
| DE | 29818873 | 3/2000 |
| DE | 20006881 | 7/2000 |
| NL | 1023576 | 12/2004 |

OTHER PUBLICATIONS

Extended Search Report, including the Search Opinion, as issued for corresponding European Patent Application No. 10162878.2, dated Sep. 1, 2010.

(Continued)

*Primary Examiner* — Daniel P Cahn

(74) *Attorney, Agent, or Firm* — Pillsbury Winthrop Shaw Pittman LLP

(57) ABSTRACT

A folding sawhorse includes an elongate plastic body having a top wall with an upper work surface, and a plurality of side walls, the walls defining a storage compartment. The folding sawhorse further comprises a plurality of metal legs that are pivotally disposed relative to the plastic body, the legs being movable between a deployed position wherein the legs are capable of supporting the plastic body in a condition for use, and a storage position in which the legs are folded so as to be substantially disposed in the storage compartment, wherein the metal legs forcibly engage with adjacent plastic surfaces of the plastic body when the legs are deployed. The folding sawhorse further comprises each leg pair comprising a first pivot axis allowing the pair of legs to be pivoted together outwardly from the storage compartment to an extended position, and a second pivot axis allowing pair of legs to be pivotally separated away from one another to the deployed position. The folding sawhorse may further comprise a handle portion recessed in the top wall so as not to project above the work surface. The folding sawhorse may further comprise a latch member pivotally connected with one of the side walls and latchable to an opposite of the side walls to lock the legs in the storage compartment.

49 Claims, 25 Drawing Sheets

(56) References Cited

U.S. PATENT DOCUMENTS 1,778,566 A 10/1930 Pitner
2,216,187 A 9/1939 Dion
2,396,737 A 3/1946 Maclaskey
2,473,342 A 6/1949 Larson
2,832,648 A 6/1956 Goosmann
2,824,771 A 2/1958 Blenski
3,198,286 A 8/1965 Wilson
3,269,487 A 8/1966 Larson
3,286,788 A 11/1966 Swanson
3,481,430 A 12/1969 Solomon
3,616,873 A 11/1971 Kehrig
3,618,704 A 11/1971 Smith, Jr.
3,631,941 A * 1/1972 Greenman ..... E04G 1/34 182/155
3,633,709 A 1/1972 Weser
3,637,045 A 1/1972 Poffenbaugh et al.
3,682,272 A 8/1972 Secor
3,722,621 A * 3/1973 Jones ..... E04G 5/10 182/118
3,810,527 A 5/1974 Kramer
3,951,233 A 4/1976 Meyers
4,030,565 A 6/1977 Chaput
4,191,111 A * 3/1980 Emmert ..... A47B 3/0916 108/132
4,296,834 A 10/1981 Kroger
4,319,663 A 3/1982 Barden
4,403,678 A 9/1983 Zieg
4,489,808 A * 12/1984 Voye ..... F16M 13/00 182/155
4,496,028 A * 1/1985 Peterson ..... 182/186.5
4,605,099 A 8/1986 Crum et al.
4,640,386 A 2/1987 Hall
4,645,162 A * 2/1987 Roy ..... B25H 1/06 182/155
4,711,319 A * 12/1987 Sansotta ..... B25H 1/04 182/155
4,730,698 A 3/1988 Harris
4,771,863 A 9/1988 Stansberry
4,804,064 A 2/1989 Coultrup et al.
4,880,080 A * 11/1989 Brockman ..... B25H 1/06 182/155
4,884,658 A 12/1989 Banfield
4,967,877 A 11/1990 Wallman et al.
5,007,502 A * 4/1991 Shapiro ..... B25H 1/06 182/151
5,052,517 A 10/1991 Wallman et al.
5,096,019 A 3/1992 Kelsay
5,119,903 A 6/1992 Ulshafer, Jr.
5,125,478 A 6/1992 Henningsen
D328,355 S 7/1992 Librach
5,297,655 A 3/1994 Wolfe
5,421,430 A * 6/1995 Cox ..... B25H 1/06 182/153
5,439,073 A * 8/1995 Johnson ..... A47B 3/0818 182/153
5,467,842 A 11/1995 Meloy
5,628,382 A 5/1997 Hill
5,704,450 A 1/1998 Lunceford
5,779,003 A 7/1998 Carty
5,782,279 A 7/1998 Stecker, Sr.
D409,764 S 5/1999 Laga
6,019,193 A * 2/2000 Brown ..... B25H 1/06 182/153
6,092,627 A 7/2000 Burger
6,129,180 A 10/2000 Brady
6,286,824 B1 9/2001 Sagol
6,298,946 B1 * 10/2001 Yemini et al. ..... 182/153
6,427,804 B1 * 8/2002 Lazarus ..... 182/153
6,564,903 B2 5/2003 Krajec
6,601,675 B2 * 8/2003 Gulledge ..... 182/153
6,659,440 B2 12/2003 Levy
6,681,895 B2 * 1/2004 Virtue ..... 182/186.3
6,705,796 B2 * 3/2004 Lund ..... 404/6
7,172,053 B2 2/2007 Slavich
7,185,738 B1 * 3/2007 Clepper ..... B25H 1/06 182/155
7,240,705 B2 7/2007 Alger
D634,857 S * 3/2011 Landau ..... D25/67
D634,858 S * 3/2011 Landau ..... D25/67
2002/0011381 A1 1/2002 Wilkerson
2002/0152934 A1 * 10/2002 Haney ..... A47B 13/003 108/155
2005/0115768 A1 6/2005 Frey
2006/0289320 A1 12/2006 Miller

OTHER PUBLICATIONS

Examination Report issued in corresponding European Patent Application No. 10162878.2 dated Apr. 30, 2018.

* cited by examiner

FOLDING SAWHORSE

FIELD OF THE INVENTION

The present invention relates to a folding sawhorse.

BACKGROUND OF THE INVENTION

Conventional sawhorses commonly are comprised of a body and legs that support the body. The body is used to support workpieces that are to be cut or otherwise worked on. There is a need in the art for an improved sawhorse.

SUMMARY OF THE INVENTION

A folding sawhorse is disclosed. The folding sawhorse comprises an elongate plastic body having a top wall with an upper work surface, and a plurality of side walls, the walls defining a storage compartment. The folding sawhorse further comprises a plurality of metal legs that are pivotally disposed relative to the plastic body, the legs being movable between a deployed position wherein the legs are capable of supporting the plastic body in a condition for use, and a storage position in which the legs are folded so as to be substantially disposed in the storage compartment, wherein the metal legs forcibly engage with adjacent plastic surfaces of the plastic body when the legs are in the deployed position.

In another aspect, the folding sawhorse comprises an elongate body having a top wall with an upper work surface, and a plurality of side walls, the walls defining a storage compartment. The folding sawhorse further comprises a plurality of legs, including a first leg pair pivotally mounted towards a first side of the body, and a second leg pair pivotally mounted towards a second side of the body. The folding sawhorse further comprises the legs being movable between a deployed position wherein the legs are capable of supporting the plastic body in a condition for use, and a storage position in which the legs are folded so as to be substantially disposed in the storage compartment. The folding sawhorse further comprises each leg pair comprising a first pivot axis allowing the pair of legs to be pivoted together outwardly from the storage compartment to an extended position, and a second pivot axis along the pair of legs to be pivotally separated away from one another to the deployed position.

In another aspect of the invention, the folding sawhorse comprises an elongate, one-piece integrally molded plastic body, the one-piece integrally molded plastic body being molded to include each of (a) a top wall defining a work surface, (b) side walls, and (c) a handle portion recessed in the top wall so as not to project above the work surface. The folding sawhorse further comprises a plurality of legs that are connected with the body and capable of supporting the body in a condition of use.

In another aspect, the folding sawhorse comprises an elongate body having a top wall with an upper work surface, and a plurality of side walls, the walls defining a storage compartment. The folding sawhorse further comprises a plurality of legs that are pivotally disposed relative to the body, the legs being movable between a deployed position wherein the legs are capable of supporting the plastic body in a condition of use, and a storage position in which the legs are folded so as to be substantially disposed in the storage compartment. The folding sawhorse further comprises a latch member pivotally connected with one of the side walls and latchable to an opposite of the side walls to lock the legs in the storage compartment.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein may be considered to be drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1:
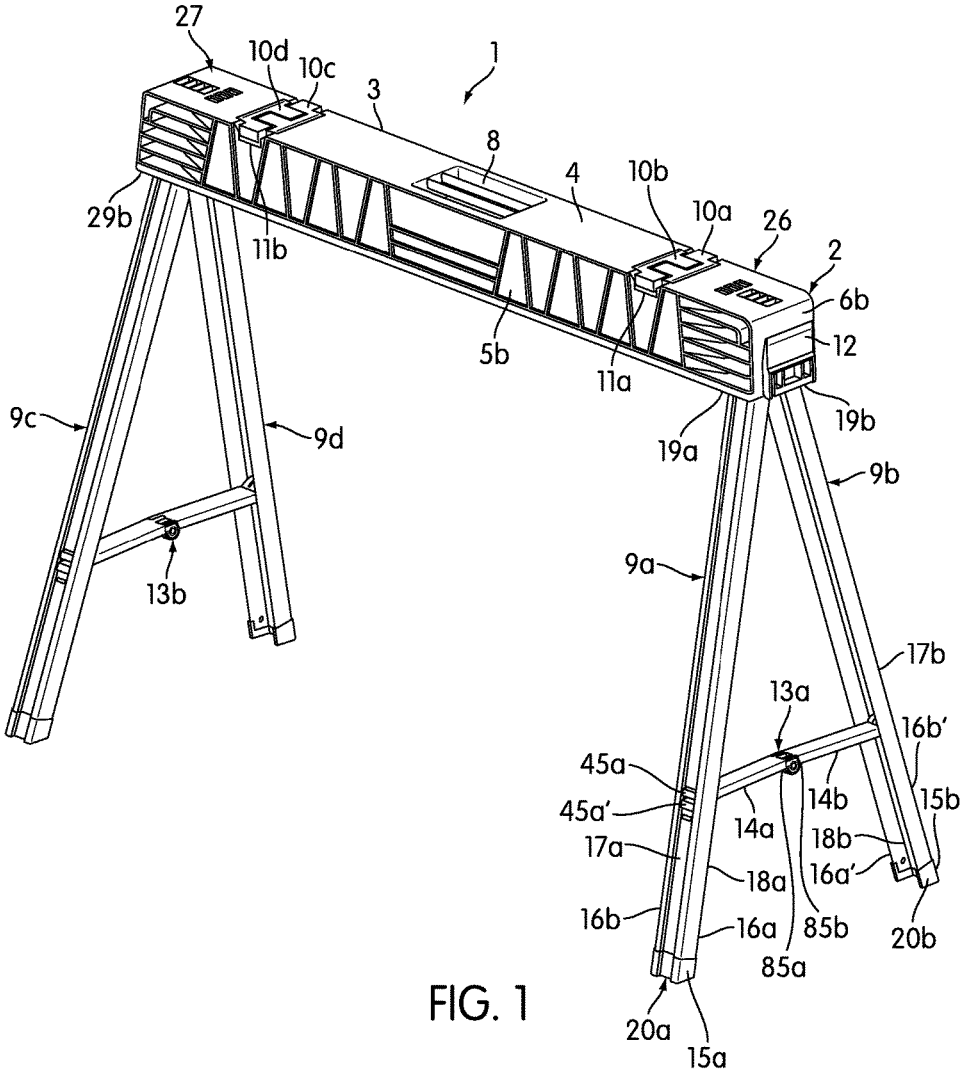
FIG. 1 is a perspective view of a folding sawhorse in accordance with an embodiment of the present invention in a deployed position.
Figure 2:
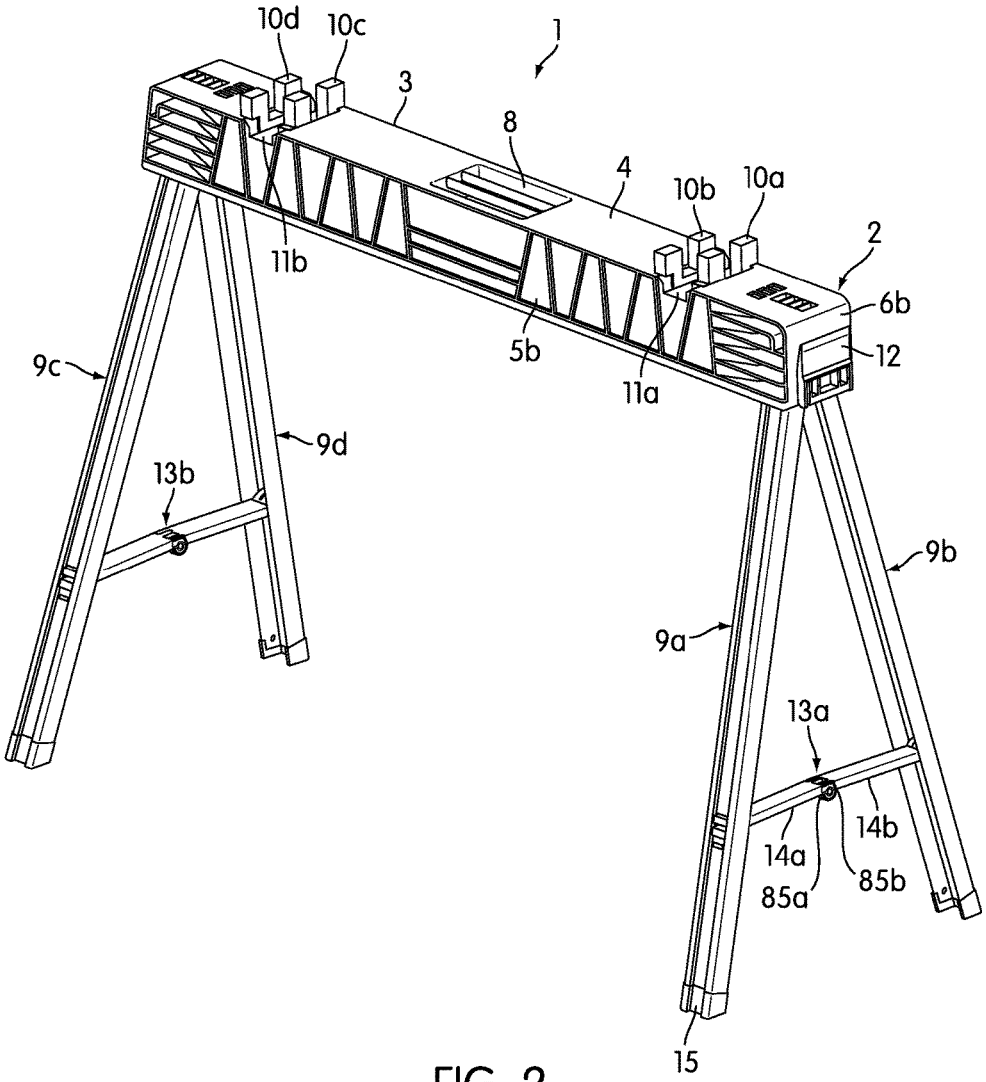
FIG. 2 is a perspective view of the folding sawhorse in a deployed position with the folding elements in an upright position.
Figure 5:
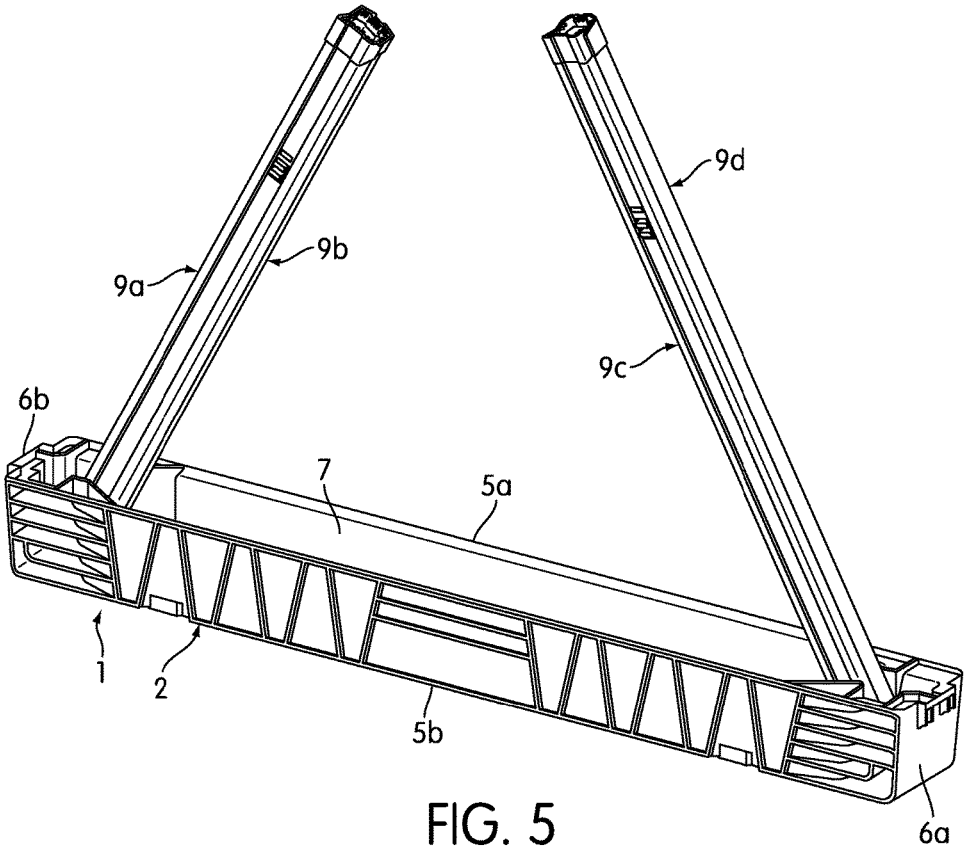
FIG. 5 is a perspective view of the folding sawhorse with the legs collapsed and partially folded inwardly.
Figure 6:
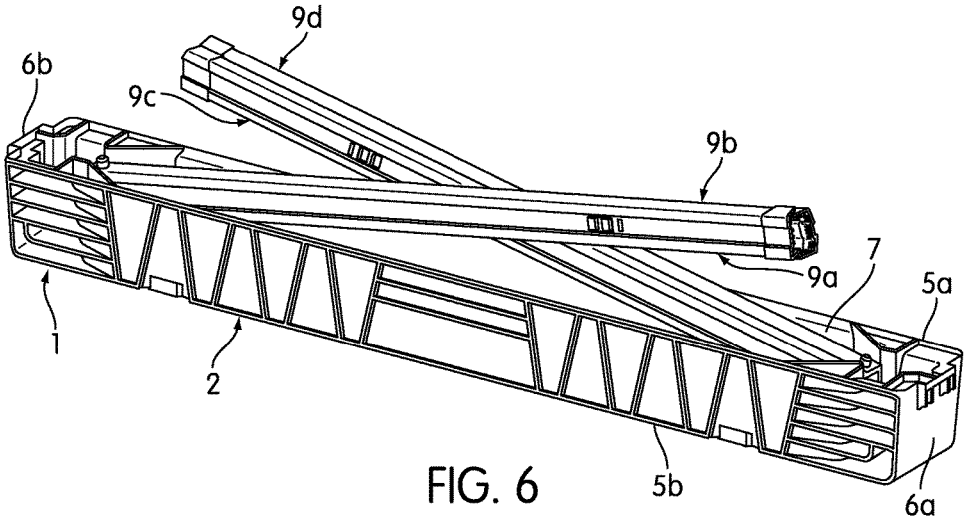
FIG. 6 is a perspective view of the folding sawhorse with the legs further folded toward the storage compartment.
Figure 7:
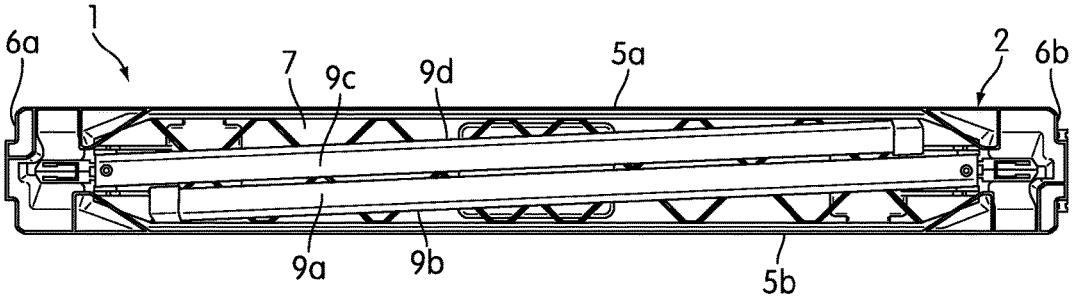
FIG. 7 is a perspective view of the folding sawhorse with the legs substantially disposed in the storage compartment.

FIGS. 1 and 2 show a folding sawhorse 1 in accordance with an embodiment of the present invention in a deployed position. The folding sawhorse 1 includes an elongate plastic body 2 having a top wall 3 with an upper work surface 4, and a plurality of side walls 5*a* (shown in FIGS. 5, 6, and 7), 5*b*, 6*a* (shown in FIGS. 5, 6, and 7), and 6*b*, the walls defining a storage compartment 7 (as shown in FIGS. 5, 6, and 7). The folding sawhorse 1 further includes a plurality of metal legs 9*a*, 9*b*, 9*c*, and 9*d* that are pivotally disposed relative to the plastic body 2. The legs 9*a*, 9*b*, 9*c*, and 9*d* are movable between a deployed position wherein the legs 9*a*, 9*b*, 9*c*, and 9*d* are capable of supporting the plastic body 2 in a condition for use, and a storage position (as shown in FIG. 7) in which the legs 9*a*, 9*b*, 9*c*, and 9*d* are folded so as to be substantially disposed in the storage compartment 7. The metal legs can be made of any suitable metal such as steel or aluminum, for example.

In the embodiment shown in FIGS. 1 and 2, the top wall 3 is molded to include an integral plastic handle 8 recessed in the top wall 3 so as not to project above the work surface 4. The handle is integrally molded with the top wall 3 and side walls 5*a*, 5*b*, 6*a*, and 6*b* so that these are all a one-piece unitary molded structure. In one embodiment, the integral plastic handle 8 is molded into the top wall 3 of the elongate plastic body 2 along upper work surface 4 at a position that is substantially centered between the side walls 6*a* and 6*b* and between side walls 5*a* and 5*b*. The integral plastic handle 8 allows folding sawhorse 1 to be easily carried by hand. In another embodiment, a top surface of the handle 8 lies in the same plane as the top surface of the top wall 3, which serves as the major work surface. Thus, in one embodiment, the top surface of handle 8 can function as part of the work surface.

In the embodiment shown in FIGS. 1 and 2, the top wall 3 of the elongate plastic body 2 has folding elements 10*a* and 10*b* disposed in recess 11*a*, and 10*c* and 10*d* disposed in recess 11*b*. The folding elements are pivotally disposed relative to the top wall 3. The folding elements 10*a*, 10*b*, 10*c*, and 10*d* can be pivoted between a storage position in which the folding elements 10*a*, 10*b*, 10*c*, and 10*d* are folded so as to be substantially disposed within recesses 11*a* and 11*b* (as shown in FIG. 1), and an upright position (as shown in FIG. 2). In one embodiment, folding elements 10*a*, 10*b*, 10*c*, and 10*d* are of essentially identical construction. Because folding elements 10*a*, 10*b*, 10*c*, and 10*d* are essentially identical, only folding element 10*a* will be discussed in detail, but the discussion applies equally to folding elements 10*b*, 10*c*, and 10*d*. The folding element 10*a* has a through-hole (not shown) that transverses the length of the folding element along the lower end of folding element 10*a*. Furthermore, folding element apertures (not shown) are molded in the top wall 3 within the recess 11*a*. A metal rod (not shown) is then inserted into folding element aperture, through through-hole, and into another folding element aperture. This configuration allows folding element 10*a* to be pivotally disposed relative to the top wall 3.

In the embodiment illustrated in FIG. 1, legs 9*a* and 9*b* form a first leg pair that is pivotally disposed relative to each other, while legs 9*c* and 9*d* form a second leg pair pivotally disposed relative to each other. The first leg pair 9*a* and 9*b* is pivotally mounted towards a first side 26 of the plastic body 2. The first side 26 of the plastic body 2 is the side of the plastic body between the center of the plastic body and the outer surface by side wall 6*b*. The second leg pair 9*a* and 9*b* is pivotally mounted towards a second side 27 of the plastic body 2. The second side 27 of the plastic body 2 is the side of the plastic body between the center of the plastic body and the outer surface by side wall 6*a*. Because leg pair 9*a* and 9*b* and leg pair 9*c* and 9*d* are essentially identical, any discussion of leg pair 9*a* and 9*b* applies equally to leg pair 9*c* and 9*d*.

In the embodiment illustrated in FIG. 1, the leg 9*a* has a U-shaped cross section formed by two side rails 16*a* and 16*b* and a center rail 17*a* defining a channel 18*a* (obstructed from view by leg 9*a*) along the length of leg 9*a*. Similarly, leg 9*b* includes two side rails 16*a*' and 16*b*' and a center rail 17*b* (partially obstructed from view by side rail 16*b*') defining a channel 18*b* along the length of leg 9*b*. The center rails 17*a* and 17*b* include openings 45*a*, 45*a*' and 45*b* (shown in FIG. 10), 45*b*' (shown in FIG. 10), respectively. The leg 9*a* and 9*b* each have two ends, top ends 19*a* (obstructed from view by plastic body 2), 19*b* (obstructed from view by plastic body 2), respectively, and bottom ends 20*a*, 20*b*, respectively. Furthermore, shoes 15*a*, 15*b* partially cover legs 9*a*, 9*b*, respectively, at the bottom ends 20*a*, 20*b*, respectively. The shoes 15*a*, 15*b* provide a slip resistant surface (e.g., made of plastic, rubber or elastomer) for the legs 9*a*, 9*b* when legs 9*a*, 9*b* are in a deployed position supporting the plastic body 2 in a condition for use. As legs 9*c*, 9*d* are substantially the same as legs 9*a*, 9*b* the foregoing description applies equally to those legs as well. The shoes 15*a*, 15*b* may also protect the underlying floor surface.

In the embodiment shown in FIGS. 1 and 2, an support rail 13*a* is disposed between leg pair 9*a* and 9*b* to further stabilize leg pair 9*a* and 9*b* in the deployed position. Support rails 13*a* and 13*b* are of essentially identical construction. Because support rail 13*a* and 13*b* are essentially identical, only support rail 13*a* will be discussed in detail, but the discussion applies equally to support rail 13*b*. The support rail 13*a* has two portions 14*a* and 14*b*. Each portion 14*a* and 14*b* is substantially one half of support rail 13*a*. The portions 14*a* and 14*b* are pivotally disposed relative to each other at ends 85*a*, 85*b*, respectively, and pivotally disposed relative to legs 9*a* and 9*b* via hinges disposed at openings 45*a*, 45*a*' and 45*b*, 45*b*' in the legs 9*a* and 9*b* (shown in FIG. 10), respectively. When the support rail 13*a* is in a straight position (shown in FIGS. 1 and 2) the leg pair 9*a* and 9*b* is in a deployed position, capable of supporting the plastic body 2 in a condition for use.

In the embodiment shown in FIGS. 1 and 2, the support rail 13*a* is made of plastic. The use of plastic is not intended to be limiting, and the support rail 13*a* may be made of any other suitable material or combination thereof as is well known in the art.

Figure 3:
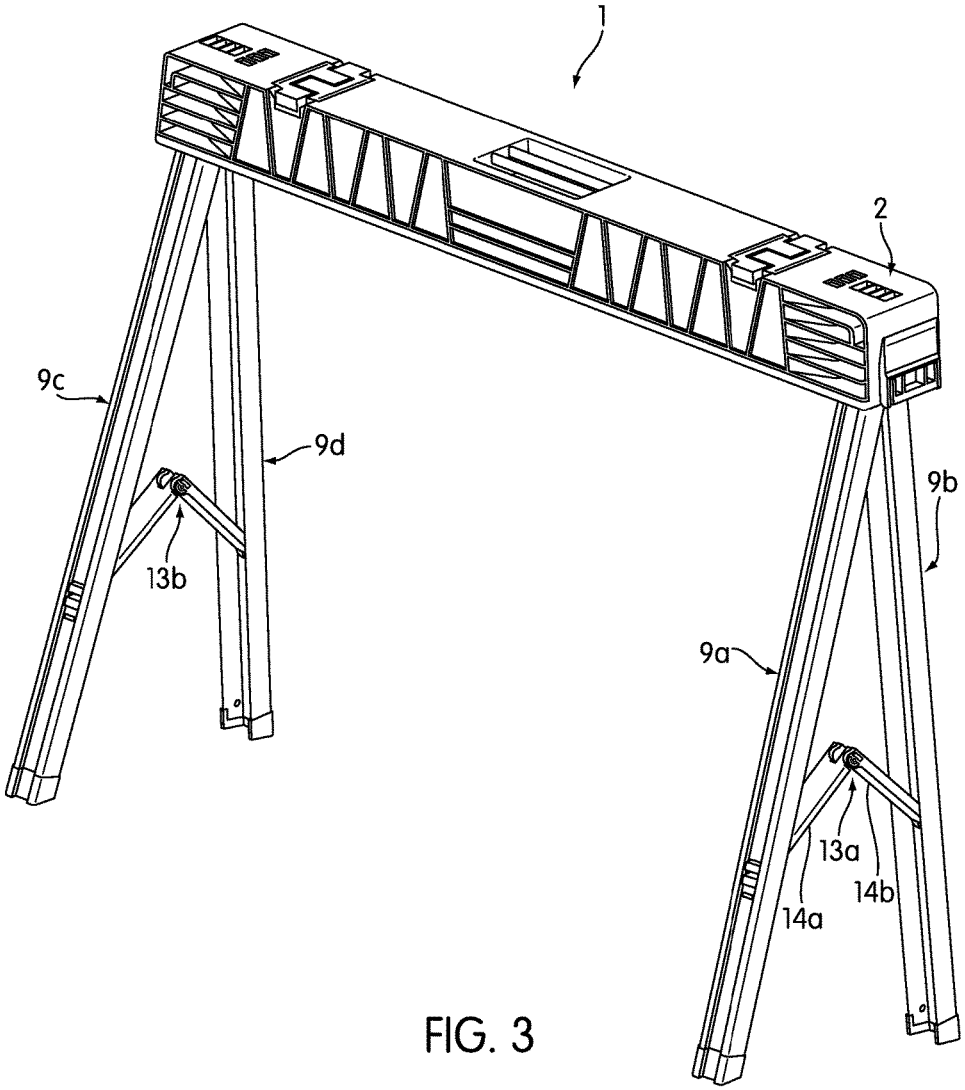
FIG. 3 is a perspective view of the folding sawhorse with the legs partially collapsed toward each other.

FIG. 3 shows an embodiment wherein legs 9*a* and 9*b* are partially collapsed inwardly toward each other. The support rail 13*a* is folded when portions 14*a* and 14*b* are collapsed toward each other.

Figure 4:
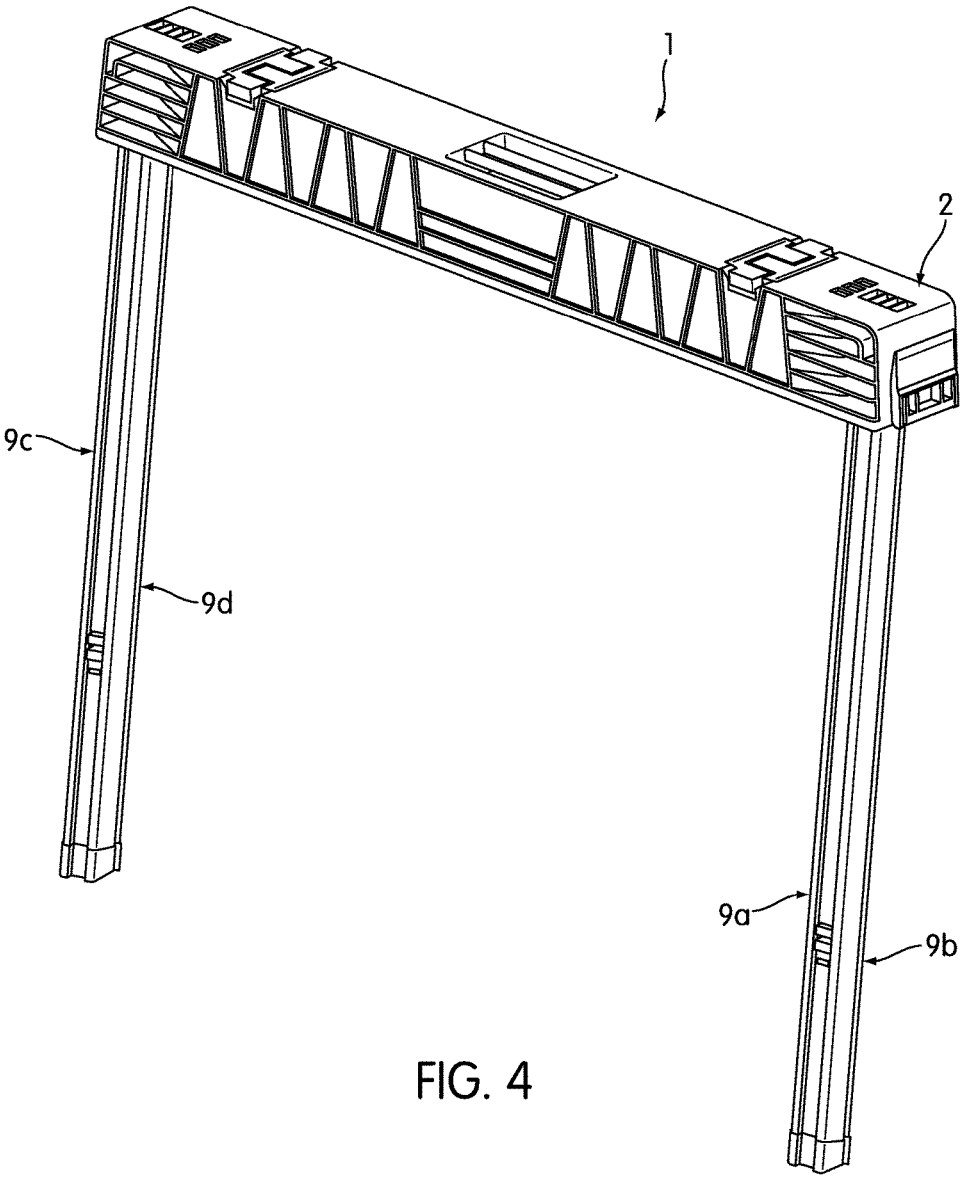
FIG. 4 is a perspective view of the folding sawhorse with the legs fully collapsed together.

FIG. 4 shows an embodiment wherein leg pair 9*a* and 9*b* and leg pair 9*c* and 9*d* are fully collapsed together. Leg pair 9*a* and 9*b* and leg pair 9*c* and 9*d* are in an extended position. The support rail 13*a* is folded so that the two portions 14*a* (shown in FIG. 3) and 14*b* (shown in FIG. 3) are collapsed together. The support rail 13*a* is entirely disposed within channels 18*a*, 18*b*.

FIG. 5 shows an embodiment wherein the leg pair 9*a*, 9*b* and the leg pair 9*c*, 9*d* are fully collapsed together. Each leg pair 9*a* and 9*b*, and 9*c* and 9*d* is partially folded inwardly from the extended position toward the storage compartment 7.

FIG. 6 shows an embodiment wherein the leg pair 9*a* and 9*b* and the leg pair 9*c* and 9*d* are fully collapsed together. Each leg pair 9*a* and 9*b*, and 9*c* and 9*d* is further folded toward the storage compartment 7.

In the embodiment shown in FIG. 7, leg pair 9*a*, 9*b* and leg pair 9*c*, 9*d* are in a storage position in which the leg pair 9*a*, 9*b* and leg pair 9*c*, 9*d* are folded so as to be substantially disposed in the storage compartment 7.

Figure 8:
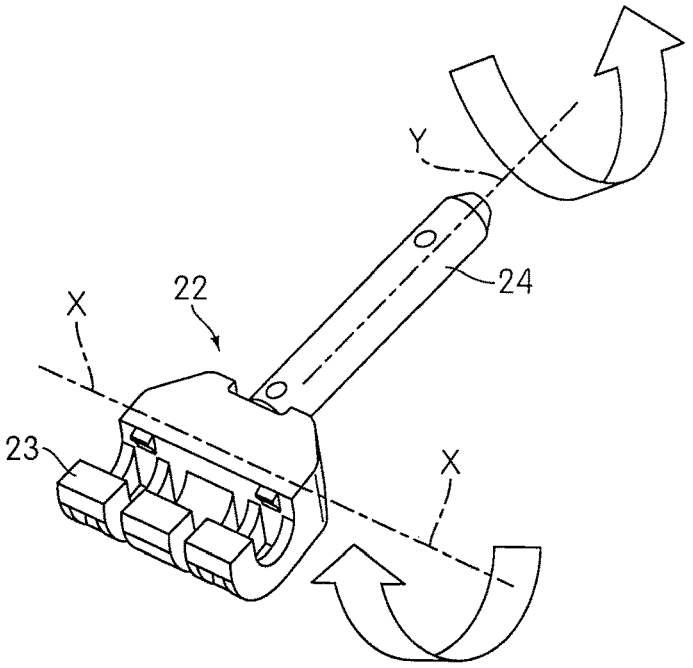
FIG. 8 is a perspective view of a pivot structure.

In the embodiment shown in FIG. 8, a pivot structure 22, which is used to pivotally mount a pair of legs to the body as will be described, comprises a recess portion 23 and a rod portion 24. The recess portion 23 forms a first pivot axis X. The rod portion 24 forms a second pivot axis Y. In the embodiment, the pivot structure 22 is made of plastic.

Figure 9:
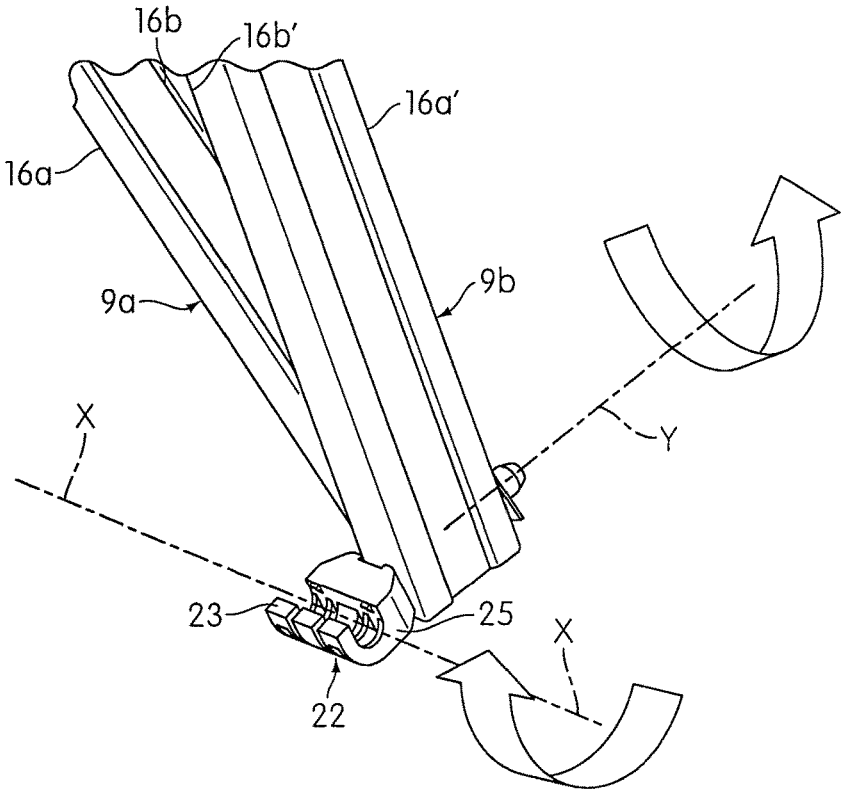
FIG. 9 is a partial perspective view of the pivot structure forming a pivot axis for a pair of legs.
Figure 10:
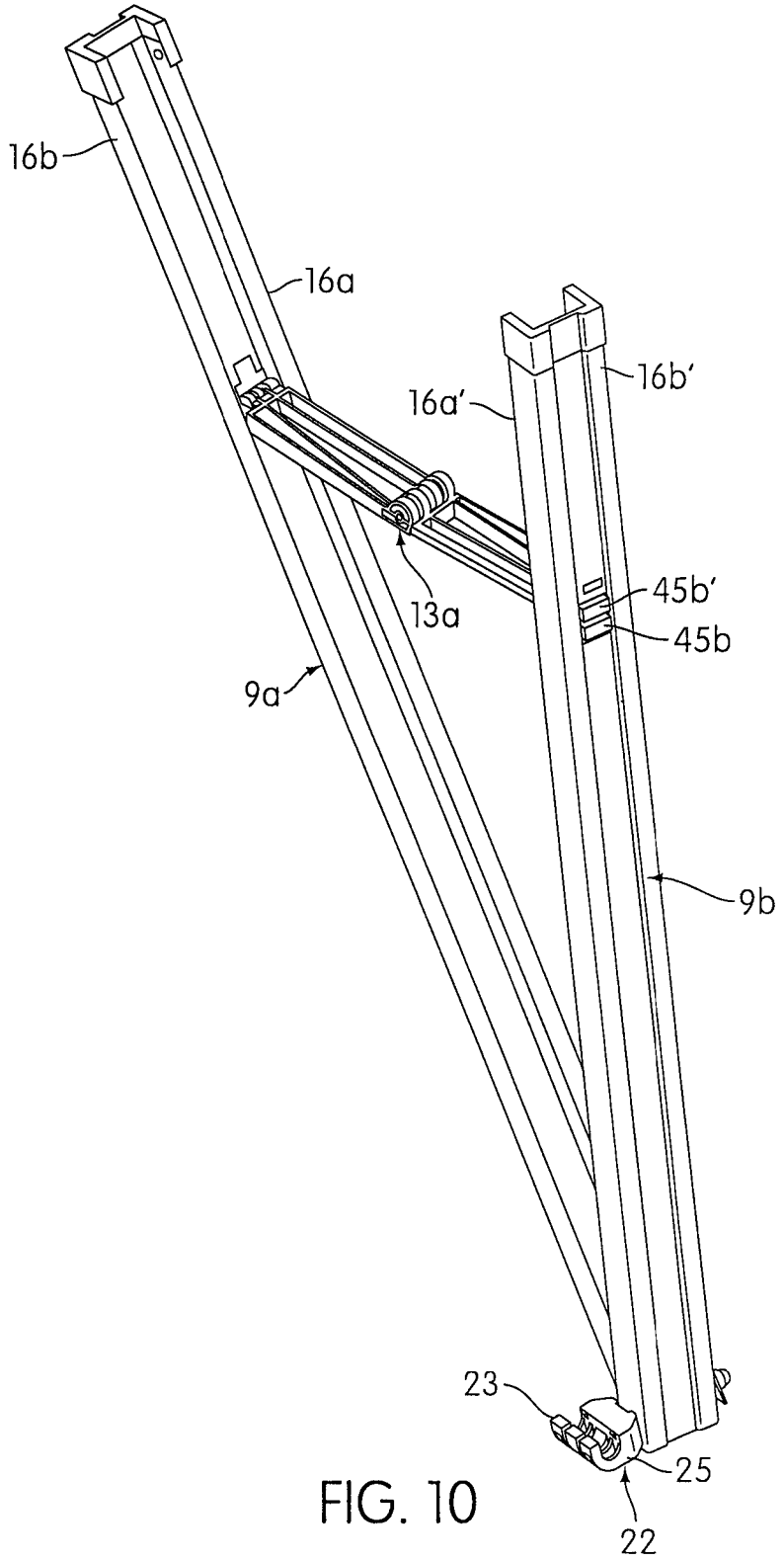
FIG. 10 is a perspective view of the pivot structure forming a pivot axis for a pair of legs.

FIGS. 9 and 10 show an embodiment wherein the rod portion 24 of the pivot structure 22 is inserted through through-holes 25 (obstructed from view by pivot structure 22) formed in both side rails 16*a*, 16*b* and 16*a*', 16*b*' of the legs 9*a* and 9*b*, respectively. Therefore, the rod portion 24 of the pivot structure 22 forms the second pivot axis Y allowing the pair of legs 9*a* and 9*b* to be pivotally separated away from one another to and from the deployed position.

Figure 11:
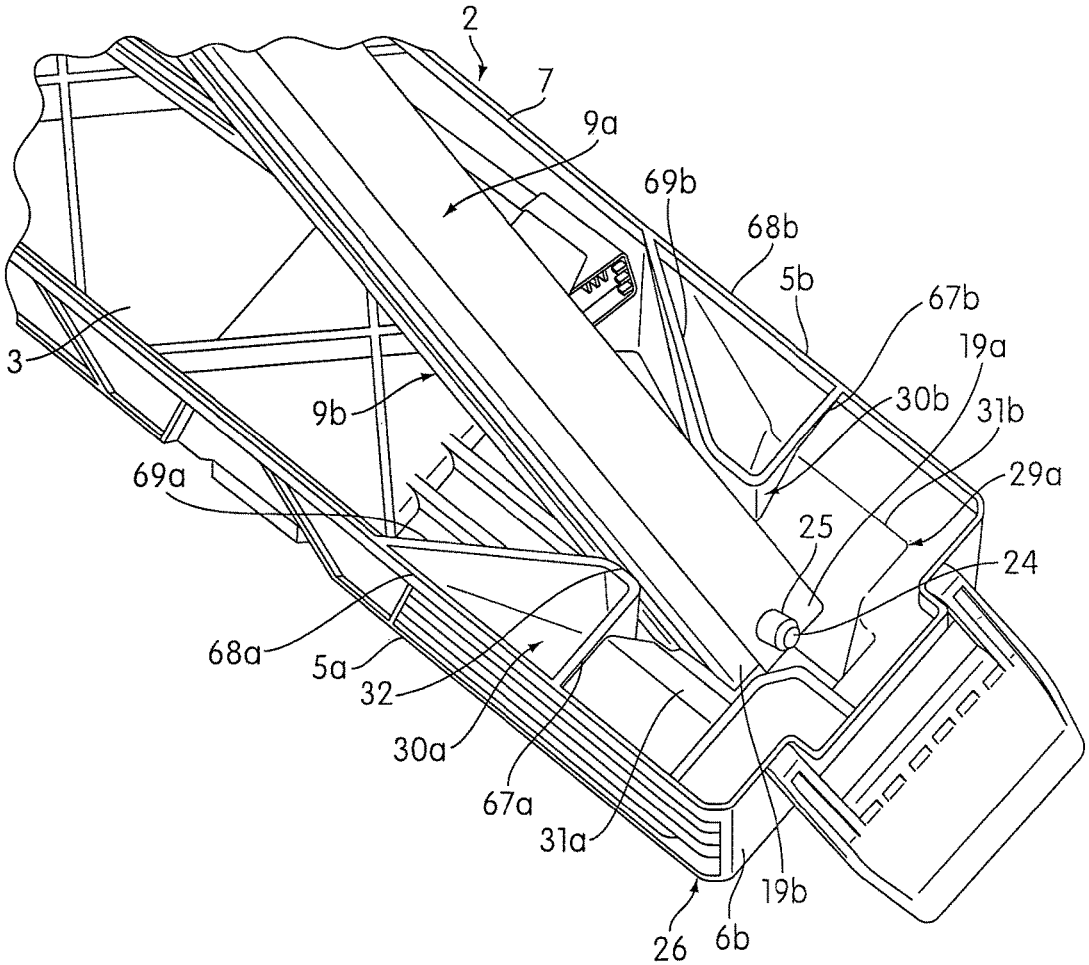
FIG. 11 is a partial perspective view of the leg retaining compartment with a leg pair in a partially extended position.

In the embodiment shown in FIG. 11, the leg pair 9*a* and 9*b* is pivoted relative to the first pivot axis X from the storage compartment 7 to a partially extended position. The rod portion 24 of the pivot structure 22 is inserted through through-holes 25 (partially obstructed from view by rod portion 24) formed in side rails 16*a*, 16*b* and 16*a*', 16*b*' of legs 9*a*, 9*b*, respectively. The recess portion 23 of the pivot structure 22 comprises a resilient C-shaped clamp that receives an inner rod 33 (shown in FIG. 13) molded into the inner side of the top wall 3 of the plastic body 2 so as to be pivotally connected to the inner rod 33. Therefore, the recess portion 23 of the pivot structure 22 is pivotally disposed relative to the top wall 3, forming a first pivot axis X and allows the legs 9*a* and 9*b* (shown in FIG. 12) to be pivoted together into the storage compartment 7. The top ends 19*a*, 19*b* of legs 9*a*, 9*b*, respectively, are within a leg retaining compartment 29*a*.

Referring back to FIG. 11, the leg retaining compartment 29*a* is formed by side wall 6*b*, top wall 3, inner ramps 30*a* and 30*b*, and side wall ramps 31*a* and 31*b*. The leg retaining compartment 29*a* is on the first side 26 of the plastic body 2. Another leg retaining compartment 29*b* (obstructed from view in FIGS. 1 and 2 by side wall 5*b*) is on the second side 27 (shown in FIG. 1) of the plastic body 2. Leg retaining compartment 29*a* and 29*b* are of essentially identical construction. Because leg retaining compartments 29*a* and 29*b* are essentially identical, only leg retaining compartment 29*a* will be discussed in detail, but the discussion applies equally to leg retaining compartment 29*b*. Inner ramps 30*a* and 30*b* are integrally molded with the inner surface of side walls 5*a* and 5*b* of the plastic body 2. Each inner ramp 30*a* and 30*b* is essentially identical, but molded on opposite side walls 5*a* and 5*b*, respectively. Each inner ramp 30*a*, 30*b* has a triangle-like configuration, with one side 67*a*, 67*b*, respectively, forming part of the leg retaining compartment 29*a*, one side 68*a*, 68*b*, respectively, formed by side wall 5*a*, 5*b*, respectively, and the hypotenuse 69*a*, 69*b*, respectively, molded to connect the sides 67*a*, 67*b*, respectively, and sides 68*a*, 68*b*, respectively. The triangle-like configuration is not intended to be limiting, and inner ramps 30*a*, 30*b* may have any other suitable configuration. Timer ramps 30*a* and 30*b* of the plastic body 2 form inwardly extending projections. Inner ramps 30*a* and 30*b* are spaced apart a distance approximately equal to the width of leg pair 9*a*, 9*b* when leg pair 9*a*, 9*b* is in a collapsed position. Therefore, the inwardly extending projections of the inner ramps 30*a*, 30*b* form an opening or a passage 32 that permits leg pair 9*a* and 9*b* to be folded so as to be substantially disposed in the storage compartment 7. That is, as shown in FIG. 11, the inwardly extending projections define the passage 32 through which the pair of metal legs 9*a*, 9*b* together can pass, and wherein after the pair of metal legs 9*a*, 9*b* passes through the passage 32, the metal legs 9*a*, 9*b* can be separated to the deployed position behind the projections. The inner ramps 30*a* and 30*b* also function to guide leg pair 9*a*, 9*b* toward one side of storage compartment 7 when leg pair 9*a*, 9*b* is collapsed into a storage position. For example, as can be seen from FIG. 7, the legs 9*a*, 9*b* pivotally connected toward the first side 26 of the top body 2 (near side wall 6*b*) is received toward the bottom side of the compartment 7, while the legs 9*c*, 9*d* are received toward the upper side of the compartment 7. It can be seen that the leg pairs 9*a*, 9*b* and 9*c*, 9*d* are disposed at an angle with respect to the longitudinal axis of top body 2. Furthermore, the side wall ramps 31*a*, 31*b* arc molded on the inner side of the side walls 5*a*, 5*b*, respectively, of plastic body 2. The surface of the side wall ramps 31*a*, 31*b* is slanted outwardly from the top wall 3.

Figure 12:
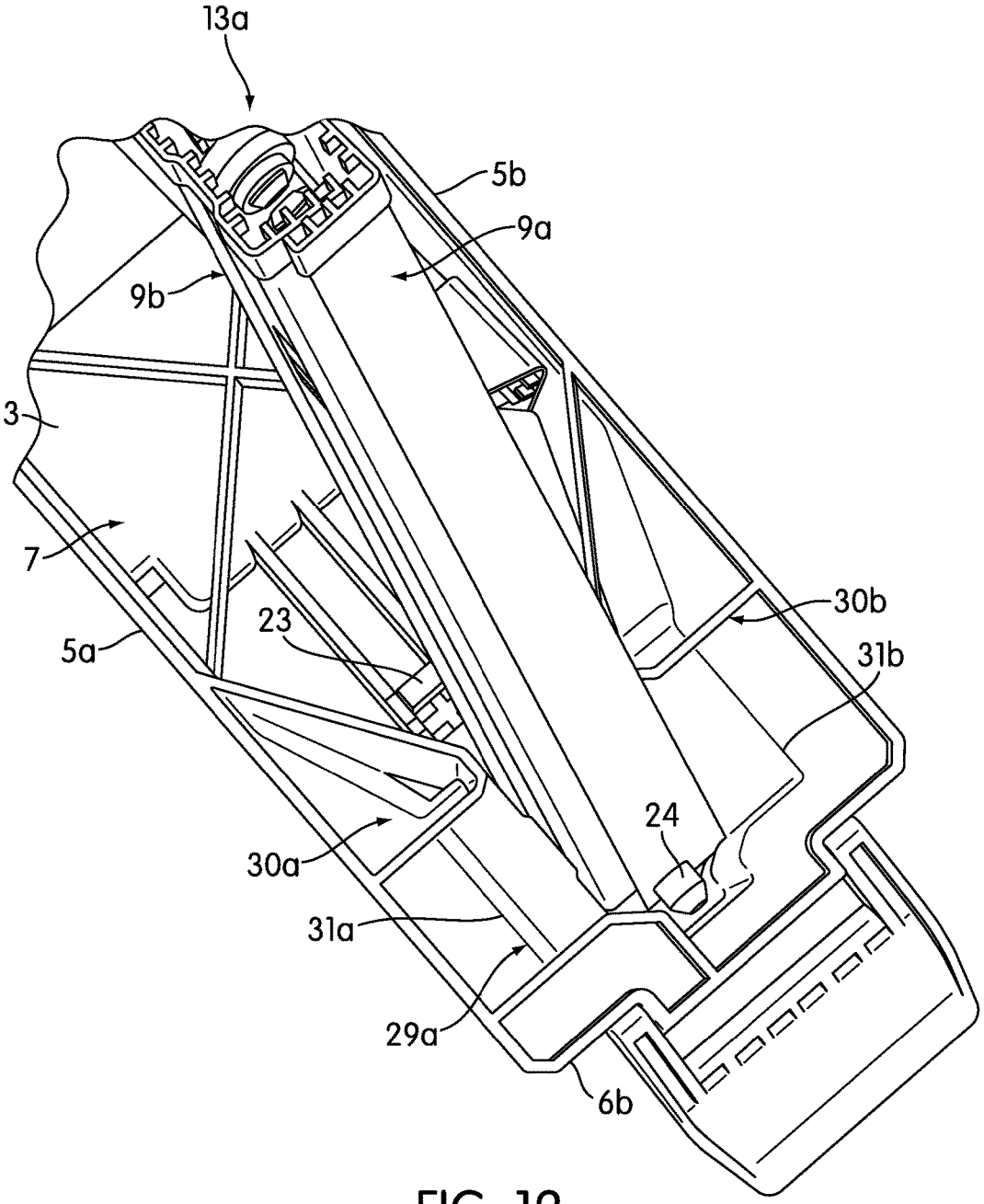
FIG. 12 is a partial perspective view of the leg retaining compartment with the leg pair in a further partially extended position.

FIG. 12 shows an embodiment wherein the leg pair 9*a*, 9*b* is further pivoted relative to the first pivot axis X from the storage compartment 7 to a partially extended position.

Figure 13:
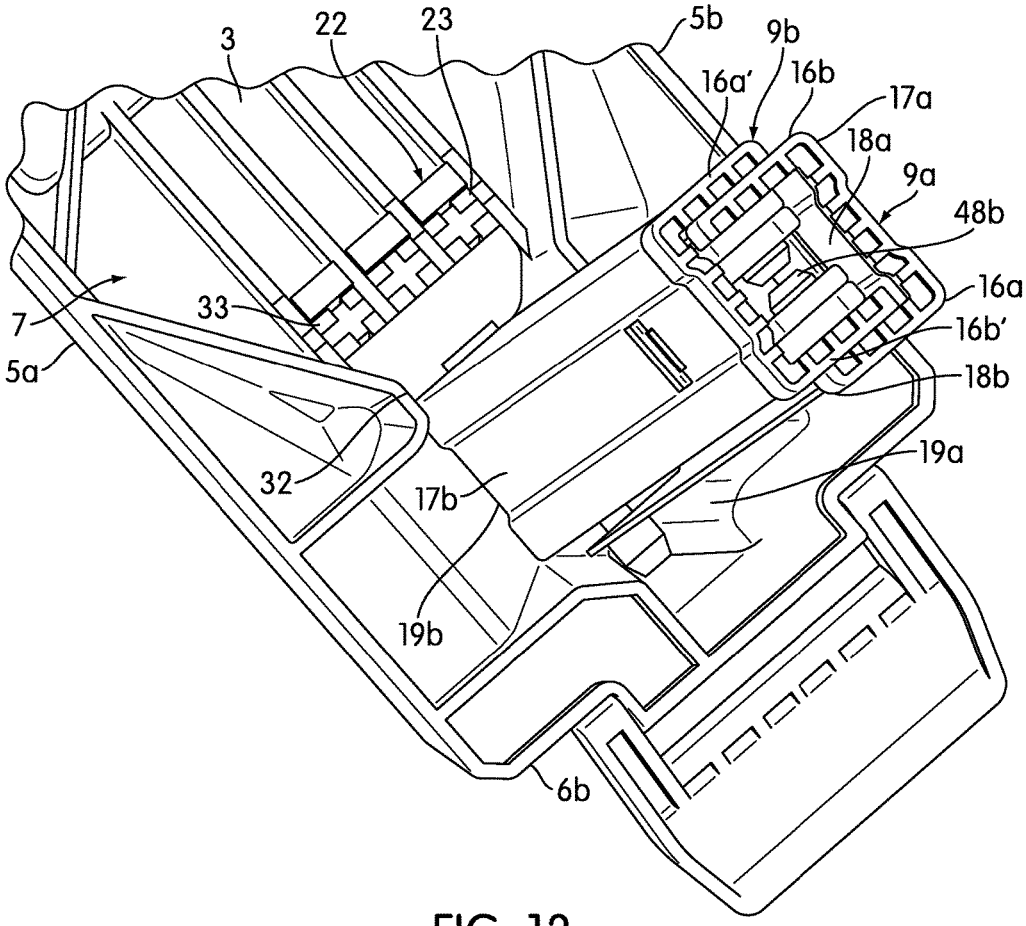
FIG. 13 is a partial perspective view of the leg retaining compartment with the leg pair in an extended position.

FIG. 13 shows an embodiment wherein the leg pair 9*a*, 9*b* is pivoted relative to the first pivot axis X from the storage compartment 7 to an extended position. The top end 19*a* (obstructed from view by legs 9*a*, 9*b*), 19*b* (obstructed from view by legs 9*a*, 9*b*) of legs 9*a*, 9*b* is connected within the leg retaining compartment 29*a*.

In another aspect of the embodiment shown in FIG. 13, legs 9*a* and 9*b* are at least partially nested within one another. When legs 9*a* and 9*b* are nested within one another, the side rail 16*b* is at least partially within channel 18*b*. Side rail 16*a* is outside channel 18*b*. Side rail 16*b*' is at least partially within channel 18*a*. Side rail 16*a*' is outside channel 18*a*. Side rail 16*a* overlaps with side rail 16*b*'. Side rail 16*b* overlaps with side rail 16*a*'. This partially nested position enables legs 9*a*, 9*b* to be compactly arranged when folded into the storage compartment 7.

Figure 14:
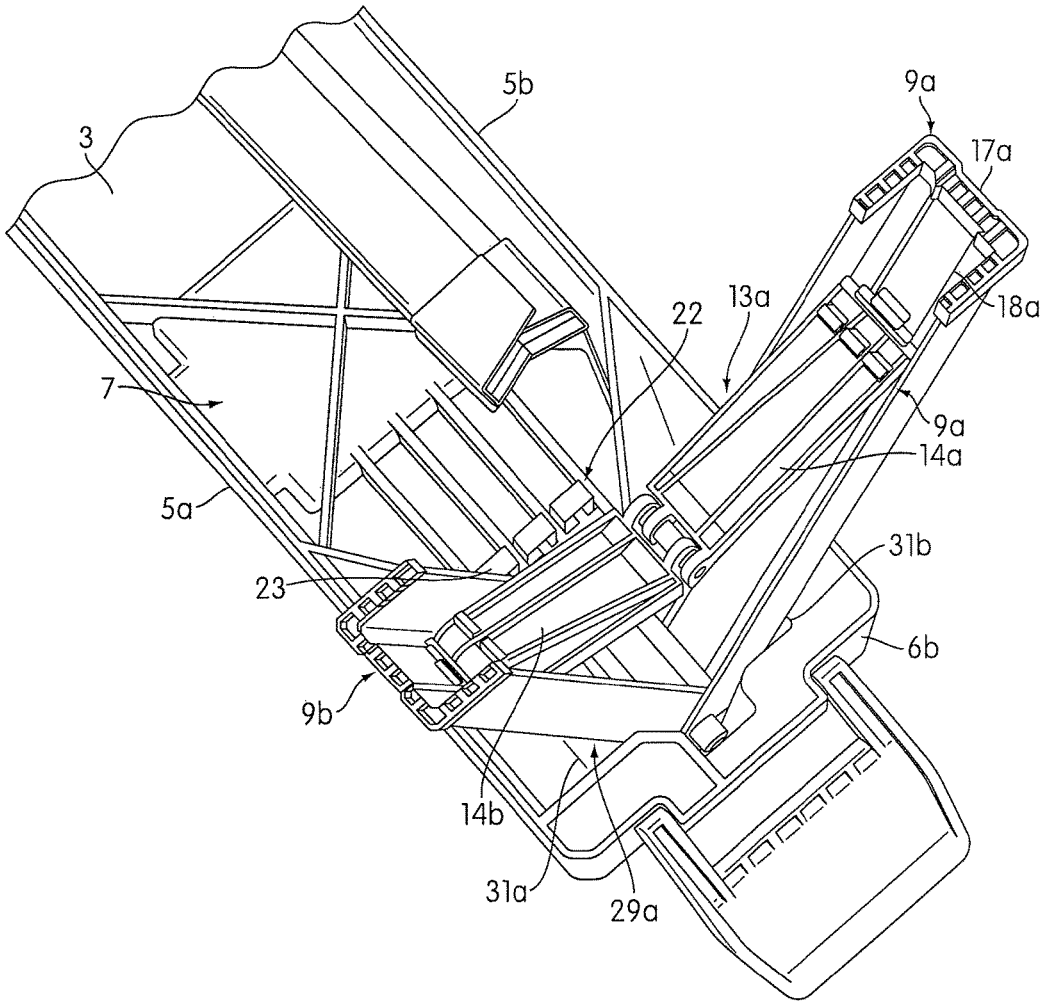
FIG. 14 is a partial perspective view of the leg retaining compartment with the leg pair in an extended position and partially separated.
Figure 15:
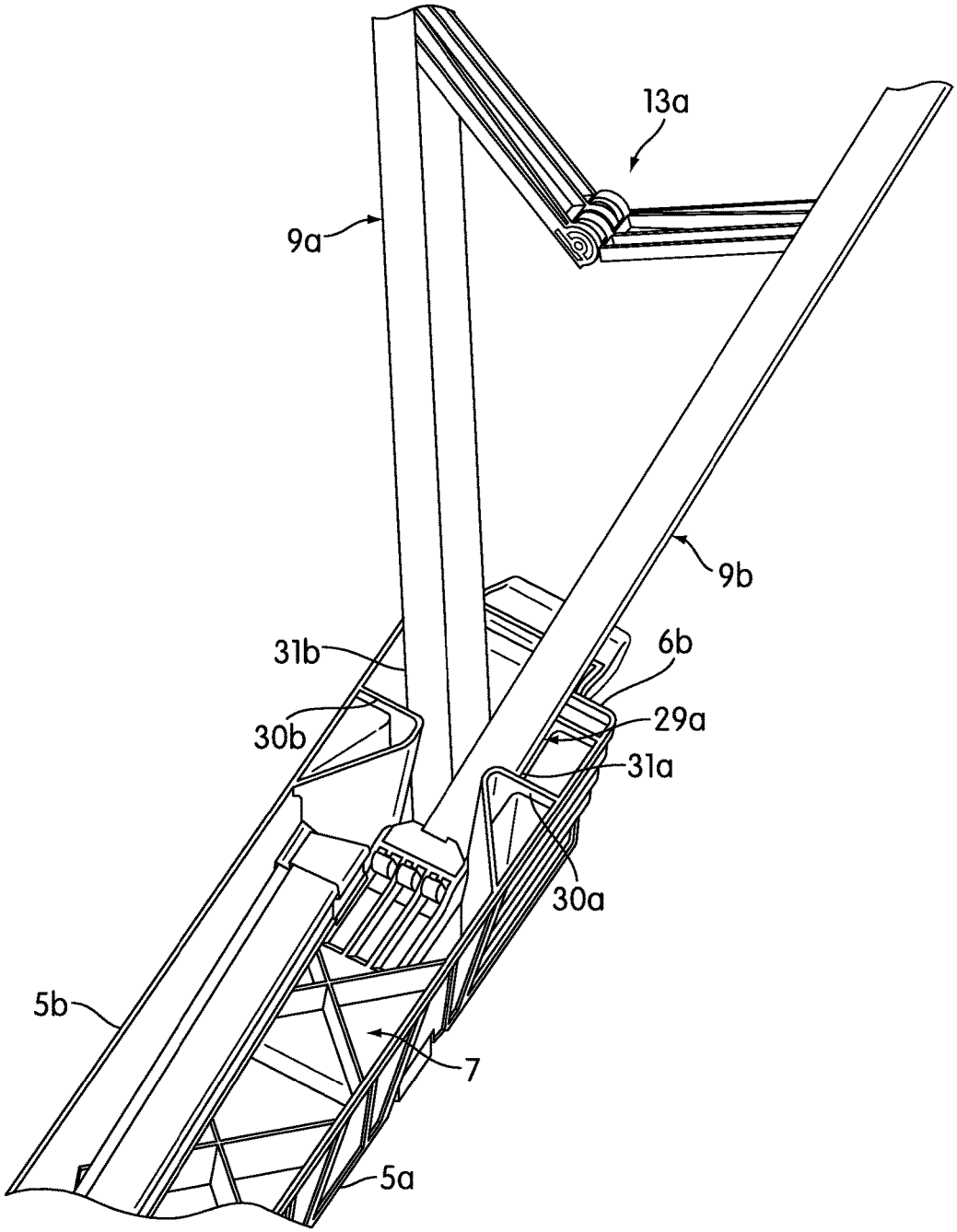
FIG. 15 is a perspective view of the of the leg retaining compartment with the leg pair in an extended position and partially separated.

In the embodiment shown in FIGS. 14 and 15, the leg pair 9*a*, 9*b* is in an extended position and partially separated away from one another. The plastic material forming inner ramps 30*a* (shown in FIG. 15), 30*b* (shown in FIG. 15) and side wall 6*b* (or inner wall structure spaced from side wall 6*b*) forcibly or frictionally engage leg pair 9*a*, 9*b*, inhibiting the leg pair 9*a*, 9*b* from pivoting relative to pivot axis X (shown in FIGS. 8 and 9). In one embodiment, the leg retaining compartment 29*a* has a width dimension (when the legs are stored and the plastic material of the inner ramps 30*a*, 30*b* are not stressed) that is slightly less than the corresponding width dimension of the legs 9*a*, 9*b*. This forcible engagement of the plastic material with the legs facilitates retention of the legs in the deployed position with little or no wiggle or relative movement between the legs 9*a*, 9*b* and the plastic body 2.

Figure 16:
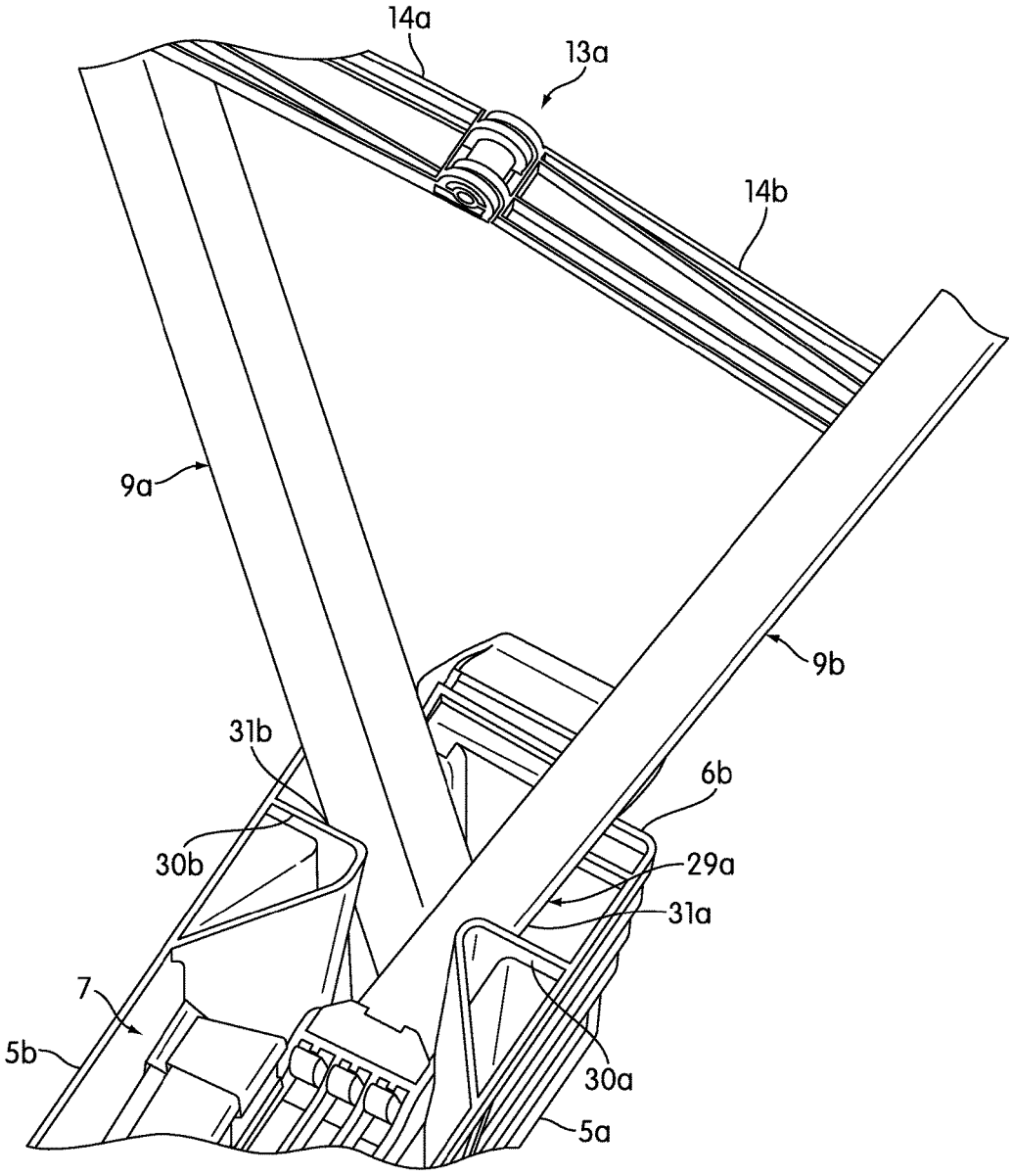
FIG. 16 is a partial perspective view of the leg retaining compartment with the leg pair in an extended position and pivotally separated to a deployed position.

In the embodiment shown in FIG. 16, the leg pair 9*a* and 9*b* is in an extended position and the legs 9*a* and 9*b* are pivotally separated away from one another to the deployed position. The plastic surfaces of inner ramps 30*a* and 30*b* and side wall 6*b* forcibly engage leg pair 9*a*, 9*b*, inhibiting or selectively preventing the leg pair 9*a*, 9*b* from pivoting relative to pivot axis X (shown in FIGS. 8 and 9) until manually pivoted. The side wall ramps 31*a* and 31*b* (obstructed from view by leg 9*a*) also forcibly engage leg pair 9*a*, 9*b*, respectively, preventing the leg pair 9*a*, 9*b* from pivoting relative to the pivot axis Y (shown in FIGS. 8 and 9) until manually pivoted when desired. It should be appreciated that while this embodiment shows and describes forcible engagement of the legs with plastic surfaces formed on various ramp and on side surfaces, the body can be molded such that any shaped plastic structure can be formed to engage the metals legs and forcibly retain them in the deployed configuration. The forcible engagement of the metal legs slightly displaces the softer and more flexible material of the plastic, and the resilience of the displaced plastic (of whatever shape that may be engineered) applies a force against the metal legs to retain them in place.

Figure 17:
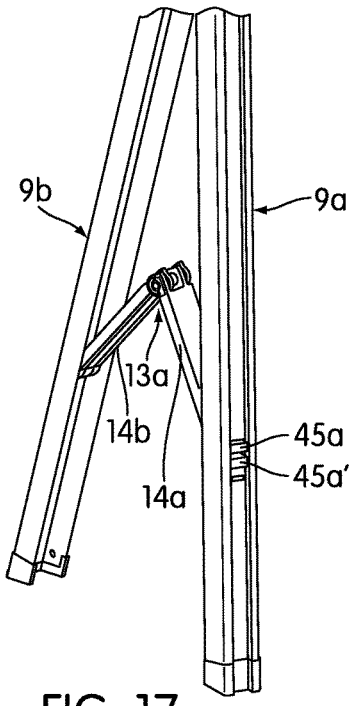
FIG. 17 is a perspective view of the leg pair in a partially separated position.

In the embodiment shown in FIG. 17, leg pair 9*a* and 9*b* is partially separated away from one another. Support rail 13*a* is folded such that portions 14 and 14*b* are partially folded together. Portions 14*a* and 14*b* are made from a resilient flexible plastic material.

Figure 18:
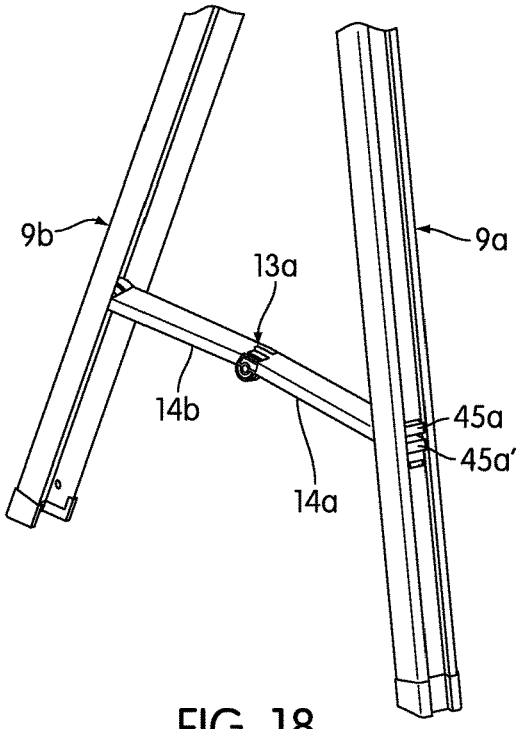
FIG. 18 is a perspective view of the leg pair in a pivotally separated position.

In the embodiment shown in FIG. 18, legs 9*a* and 9*b* are pivotally separated away from one another in a deployed position. Support rail 13*a* is in a straight position such that portions 14*a* and 14*b* are aligned horizontally next to each other.

Figure 19:
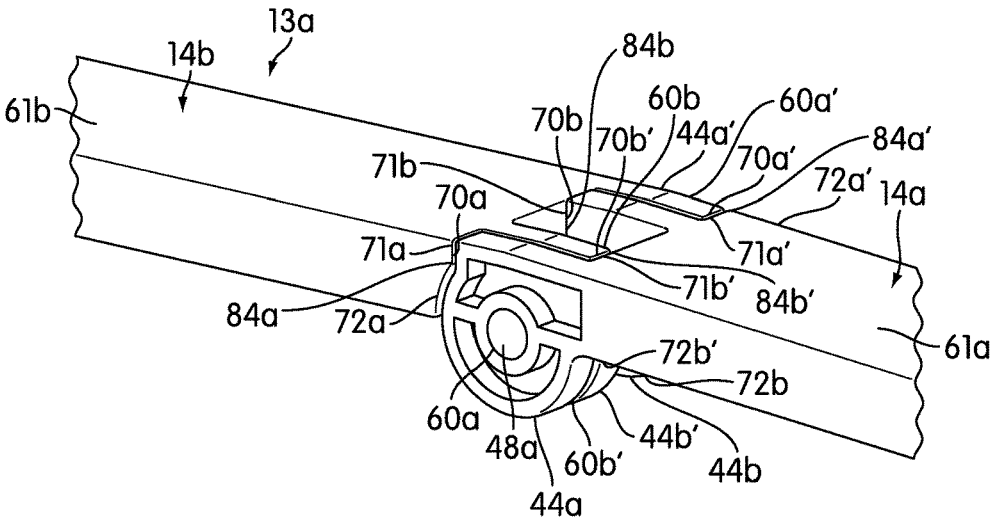
FIG. 19 is a partial perspective view of the support rail showing the ring portions.

In the embodiment shown in FIG. 19, each portion 14*a* and 14*b* of the support rail 13*a* has ring portions, 44*a* and 44*b* (obstructed from view by ring portions 44*a* and 44*b*') for portion 14*a*, and 44*a*' (obstructed from view by ring portions 44*a*, 44*b*', and 44*b*) and 44*b*' (partially obstructed from view by ring portion 44*a*) for portion 14*b*, integrally molded on one end. Each ring portion 44*a*, 44*b*, 44*a*', 44*b*' is essentially identical and semi-circular in shape. Therefore, portion 14*a* has ring portions 44*a*, 44*b* integrally molded on one end. Portion 14*b* has ring portions 44*a*', 44*b*' integrally molded on one end. Each ring portion 44*a*, 44*b*, 44*a*', and 44*b*' has a center hole 60*a*, 60*b* (obstructed from view by ring portions 44*a* and 44*b*'), 60*a*' (obstructed from view by ring portions 44*a*, 44*b*', and 44*b*), and 60*b*' (obstructed from view by ring portion 44*a*), respectively, located at a substantially centered position. Ring portions 44*a*, 44*b* and 44*a*', 44*b*' are molded below the top surfaces 61*a* and 61*b*, respectively, of portions 14*a* and 14*b*, respectively.

As shown in FIG. 19, portions 14*a* and 14*b* are pivotally disposed relative to each other. In FIG. 19, portion 14*a* is aligned with portion 14*b* such that center hole 60*a* in portion 14*a* is aligned with center hole 60*b*' in portion 14*b*, and center hole 60*b* is aligned with center hole 60*a*'. A fastener pin 48*a* is inserted through center holes 60*a* and 60*b*'. A fastener pin 48*b* (shown in FIG. 13) is also inserted through center holes 60*b* and 60*a*'. Therefore, portions 14*a* and 14*b* are fastened together, and pivotally disposed relative to one another.

In another aspect of the embodiment shown in FIG. 19, ring receiving surfaces 72*a*, 72*b* (obstructed from view by ring portions 44*a*, 44*b*'), 72*a*' (obstructed from view by ring portions 44*a*, 44*b*', and 44*b*) and 72*b*'(obstructed from view by ring portion 44*a*) are located at a position adjacent to ring portions 44*a*, 44*b*, 44*a*', and 44*b*', respectively. Ring receiving surfaces 72*a*, 72*b*, 72*a*', and 72*b*' are essentially identical and have a curved shape configured to receive a portion of ring portions 44*a*, 44*b*, 44*a*' and 44*b*', respectively.

Figure 20:
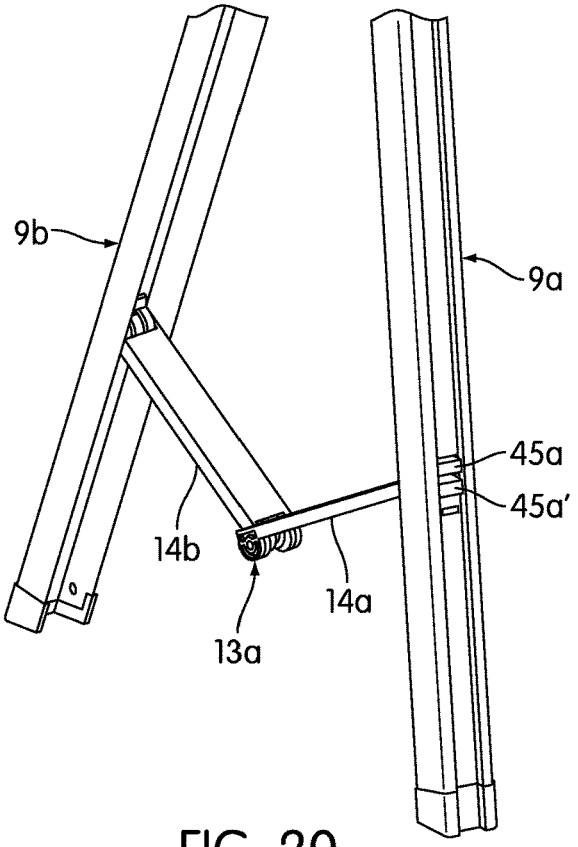
FIG. 20 is a perspective view of the leg pair with the ring portions of the support rail pivoted away from the plastic body.

First stop surfaces 70*a* and 70*b* (partially obstructed from view by ring portions 44*a*, 44*b*') are flat and are located above ring portions 44*a* and 44*b*, respectively, and below top surface 61*a*. First stop surfaces 70*a*' (obstructed from view by ring portion 44*a*, 44*b*', and 44*b*) and 70*b*' (obstructed from view by ring portions 44*a*) are located above ring portions 44*a*' and 44*b*', respectively, and below top surface 61*b*. Second stop surfaces 71*a*, 71*b* (obstructed from view by ring portion 44*a* and 44*b*') are located above ring receiving surfaces 72*a*, 72*b*, respectively, and below top surface 61*b*. Second stop surfaces 71*a*' (obstructed from view by ring portions 44*a*, 44*b*', and 44*b*), 71*b*' (obstructed from view by ring portion 44*a*) are flat and are located above ring receiving surfaces 72*a*', 72*b*', respectively, and below top surface 61*a*. Second stop surfaces 71*a*, 71*b*, 71*a*' and 71*b*' are essentially identical. Second stop surfaces 71*a*, 71*b*, 71*a*' and 71*b*' intersect with ring receiving surfaces 72*a*, 72*b*, 72*a*' and 72*b*', respectively, at vertexes 84*a*, 84*b* (obstructed from view by ring portions 44*a*, 44*b*'), 84*a*' (obstructed from view by ring portions 44*a*, 44*b*', and 44*b*) and 84*b*' (obstructed from view by ring portion 44*a*), respectively. Second stop surfaces 71*a*, 71*b*, 71*a*' and 71*b*' contact first stop surfaces 70*a*, 70*b*, 70*a*' and 70*b*', respectively, when support rail 13*a* is in a straight position. The contact between the first stop surfaces 70*a*, 70*b*, 70*a*' and 70*b*' and second stop surfaces 71*a*, 71*b*, 71*a*' and 71*b*' prevents or inhibits the ring portions 44*a*, 44*b*, 44*a*' and 44*b*' from pivoting or moving away from the plastic body 2 (as shown in FIG. 20; plastic body 2 shown in FIG. 1) unless the force applied to the support rail 13*a* exceeds a threshold level. Because portions 14*a* and 14*b* are made from a resilient flexible plastic material, if the force applied to support rail 13*a* exceeds the threshold level, first stop surfaces 70*a*, 70*b*, 70*a*' and 70*b*' are displaced from being in contact with second stop surfaces 71*a*, 71*b*, 71*a*' and 71*b*', respectively, and pass over vertexes 84*a*, 84*b*, 84*a*' and 84*b*', respectively, into a position below the second stop surfaces 71*a*, 71*b*, 71*a*' and 71*b*', respectively. The threshold level required to pivot or move ring portions 44*a*, 44*b* of portion 14*a* and ring portions 44*a*', 44*b*' of portion 14*b* away from the plastic body 2 (as shown in FIG. 20; plastic body 2 shown in FIG. 1) is greater than the force required to pivot portions 44*a*, 44*b*, 44*a*', and 44*b*' toward the plastic body 2

(as shown in FIG. 17; plastic body 2 shown in FIG. 1). Therefore, when portions 14*a* and 14*b* are pivotally disposed relative to each other, the force required to pivot or move the ring portions 44*a*, 44*b*, 44*a*' and 44*b*' away from the plastic body is greater than the force required to pivot or move ring portions 44*a*, 44*b*, 44*a*' and 44*b*' toward the plastic body 2.

In embodiment shown in FIG. 20, the support rail 13*a* is folded such that ring portions 44*a*, 44*b* of portion 14*a* and ring portions 44*a*', 44*b*' of portion 14*b* are pivoted or moved away from the plastic body 2. In order for portions 14*a* and 14*b* to be pivoted toward the plastic body 2, the force applied to the support rail 13*a* must exceed a threshold level. The threshold level required to pivot or move ring portions 44*a*, 44*b* of portion 14*a* and ring portions 44*a*', 44*b*' of portion 14*b* away from the plastic body 2 is greater than the force required to pivot or move ring portions 44*a*, 44*b*, 44*a*', and 44*b*' toward the plastic body 2 (shown in FIG. 17). This can occur when a user (inadvertently) steps on the support rail 13*a*.

Figure 21:
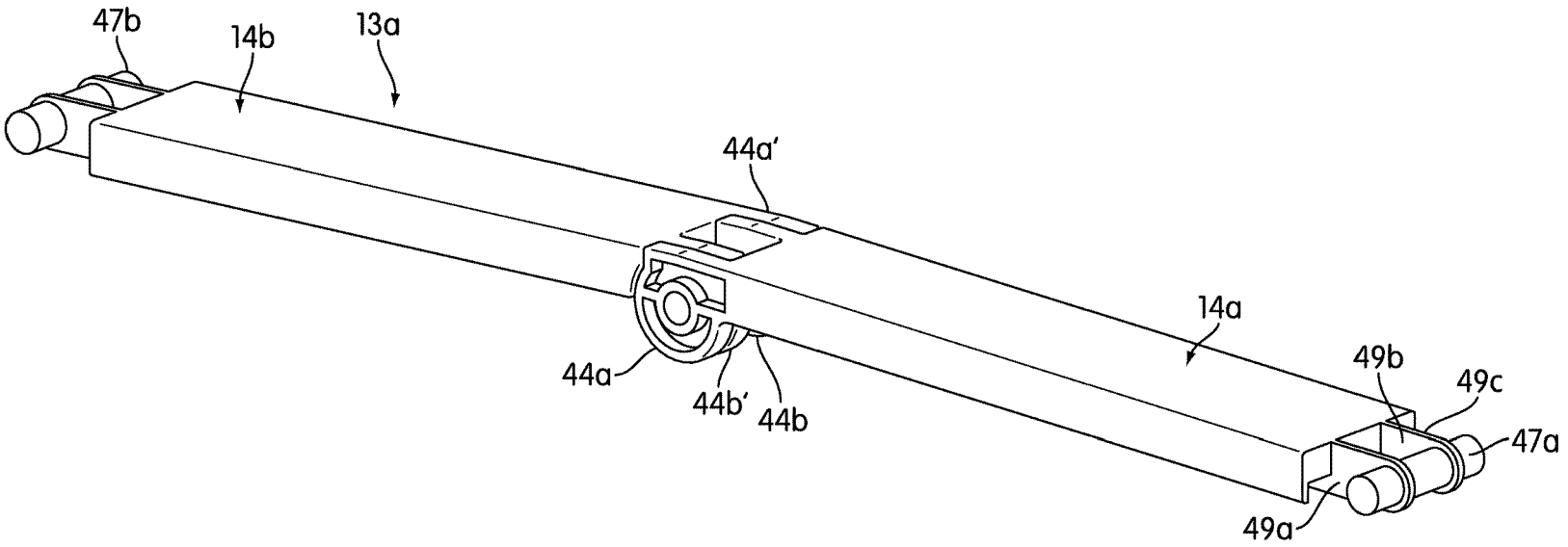
FIG. 21 is a perspective view of the support rail, showing both ring portions and rod portions.

In the embodiment shown in FIG. 21, each portion 14*a* and 14*b* of the support rail 13*a* has a rod portion 47*a* and 47*b*, respectively, integrally molded on the end opposite from ring portions 44*a*, 44*b* and 44*a*', 44*b*', respectively. Ring portions 44*a*, 44*b* (partially obstructed from view by portions 44*a* and 44*b*') and rod portion 47*a* are integrally molded with portion 14*a* so as to form a one-piece unitary molded structure. Similarly, ring portions 44*a*' (obstructed from view by portions 44*a*, 44*b*', and 44*b*), 44*b*' (partially obstructed from view by portion 44*a*) and rod portion 47*b* are integrally molded with portion 14*b* so as to form a one-piece unitary molded structure. Because portions 14*a*, 14*b* are essentially identical, only portion 14*a* will be discussed in detail in this paragraph, but the discussion applies equally to portion 14*b*. Recesses 49*a*, 49*b*, and 49*c* are located between the rod portion 47*a* and the rest of portion 14*a*.

Figure 22:
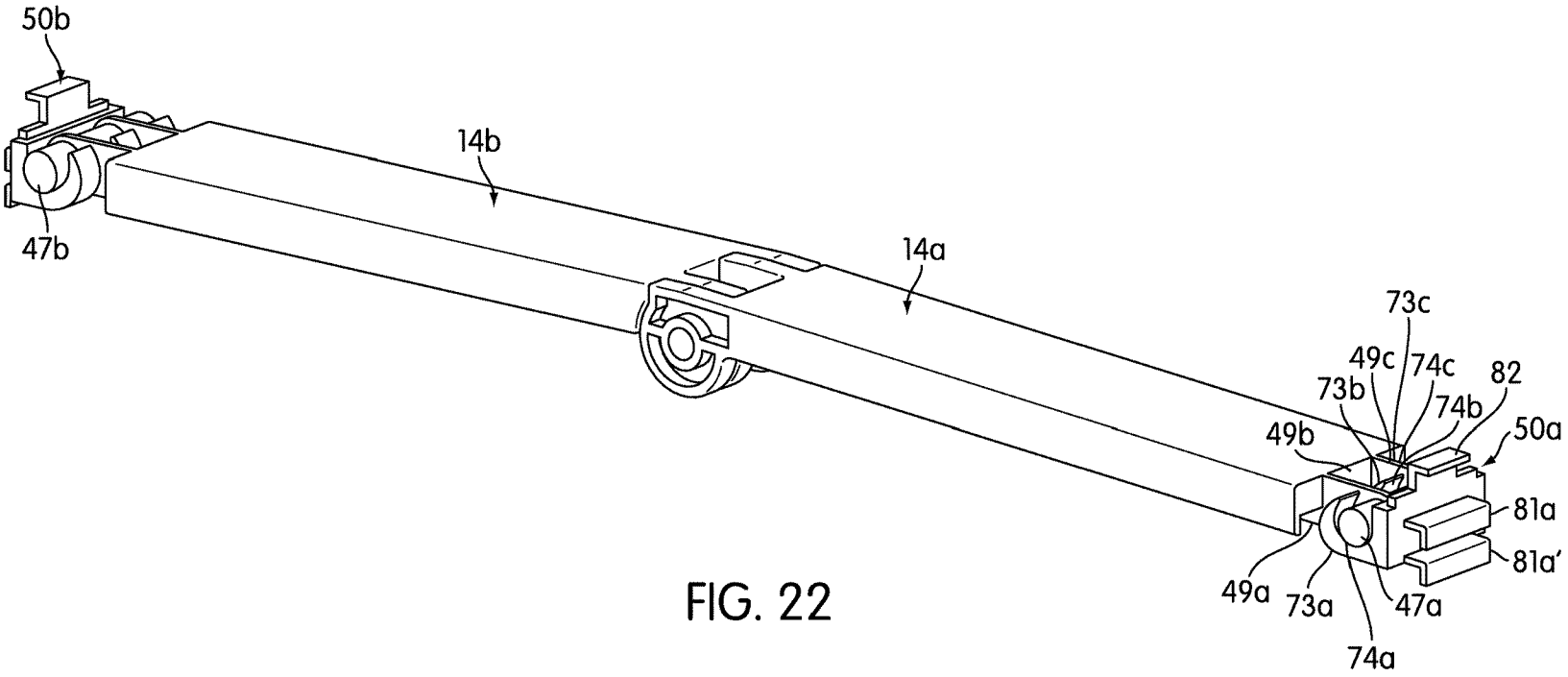
FIG. 22 is a perspective view of the support rail and rod receiving members.

In the embodiment shown in FIG. 22, portion 14*a* is pivotally disposed relative to a rod receiving member 50*a*. Portion 14*b* is pivotally disposed relative to rod receiving member 50*b*. Rod receiving members 50*a* and 50*b* are mounted through the openings 45*a* (shown in FIG. 1), 45*a*' (shown in FIG. 1) on leg 9*a* (shown in FIG. 1) and 45*b* (shown in FIG. 10), 45*b*' (shown in FIG. 10) on leg 9*b* (shown in FIG. 10), respectively, and affixed inside channels 18*a* (shown in FIG. 13) and 18*b* (shown in FIG. 13), respectively. Because rod receiving members 50*a* and 50*b* are essentially identical, only rod receiving member 50*a* will be discussed in detail, but the discussion applies essentially to the rod receiving member 50*b*. The rod receiving member 50*a* has curved portions 73*a*, 73*b* (partially obstructed from view by rod portion 47*a* and rod receiving member 50*a*), and 73*c* (obstructed from view by rod portion 47*a* and rod receiving member 50*a*) integrally molded with the rod receiving member 50*a*. Curved portions 73*a*, 73*b*, and 73*c* are essentially identical, each having a curved shape forming recesses 74*a*, 74*b*, and 74*c* configured to receive rod portion 47*a*. Rod receiving member 50*a* receives the rod portion 47*a* into recesses 74*a*, 74*b*, and 74*c* such that curved portions 73*a*, 73*b*, and 73*c* are aligned with recesses 49*a*, 49*b*, and 49*c*, respectively, allowing portion 14*a* to be pivotally disposed relative to rod receiving member 50*a*. Tabs 81*a* and 81*a*' are latched through openings 45*a* and 45*a*' to affix rod receiving member 50*a* inside channel 18*a* (shown in FIG. 14). The stop tab 82 forcibly engages the inner surface of the center rail 17*a* (shown in FIG. 14) to help affix rod receiving member 50*a* inside channel 18*a*.

Figure 23:
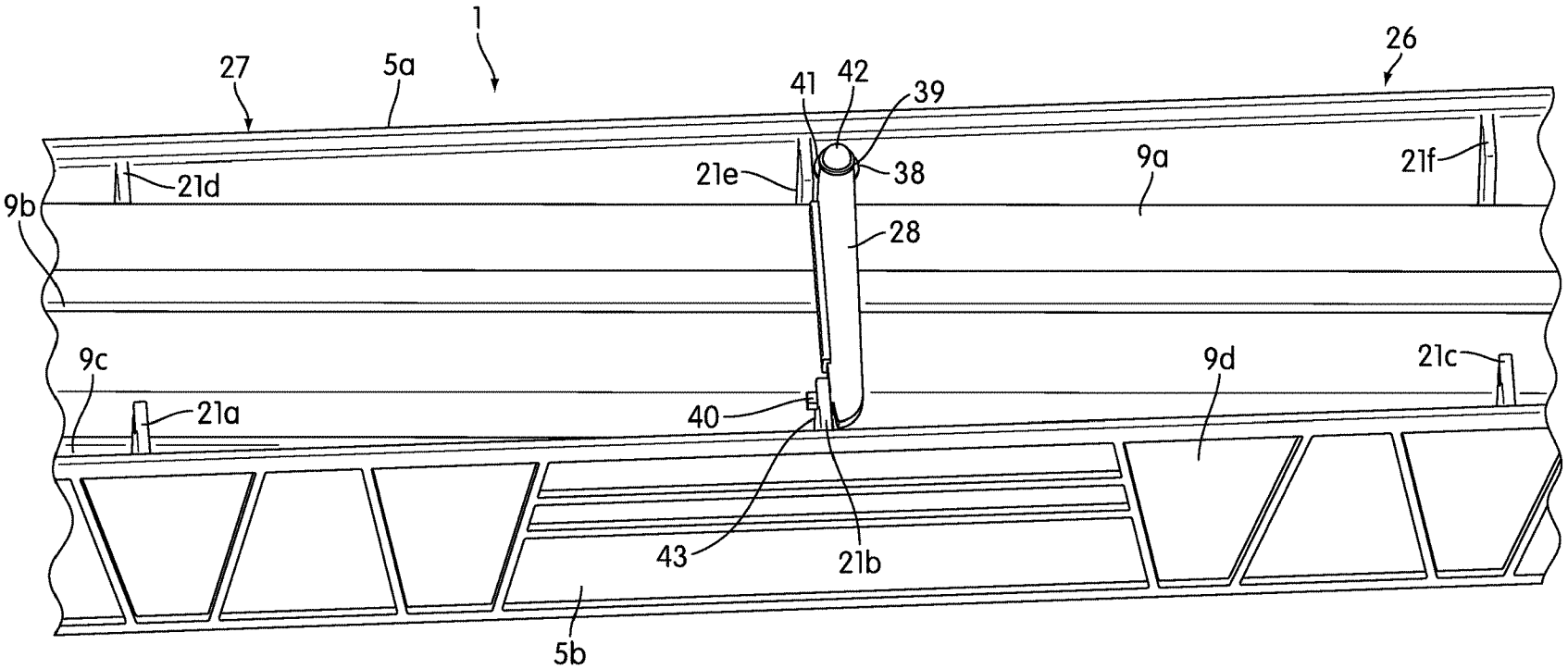
FIG. 23 is a perspective view of the folding sawhorse with the legs in a storage position showing the latch member.

In the embodiment shown in FIG. 23, leg pair 9*a*, 9*b* and leg pair 9*c*, 9*d* are frictionally held in place in the storage compartment by ribs 21*a*, 21*b*, 21*c*, 21*d*, 21*e*, and 21*f* integrally molded the side walls 5*a* and 5*b*. Side wall 5*b* has integral plastic ribs 21*a*, 21*b*, 21*c* molded at equally spaced positions along the inner surface. Side wall 5*a* also has ribs 21*d*, 21*e*, 21*f* molded at equally spaced positions along the inner surface. When the legs 9*a*, 9*b*, 9*c*, and 9*d* are in a storage position, leg pair 9*a*, 9*b* and leg pair 9*c*, 9*d* forcibly engage with the ribs 21*a*, 21*b*, 21*c*, 21*d*, 21*e*, and 21*f*, displacing the plastic material slightly so that legs 9*a*, 9*b*, 9*c*, and 9*d* remain in a storage position. Each rib 21*a*, 21*b*, 21*c*, 21*d*, and 21*e* is essentially identical.

As shown in FIG. 23, which is a perspective view of the underside of the body 2, a latch member 28 is pivotally connected to side wall 5*a* by a fastener 42 and latchable to the opposite side wall 5*b* to further prevent the legs from pivoting from a storage position into an extended position. The latch member 28 is approximately the same length as distance between the inner surfaces of side walls 5*a* and 5*b*. The latch member 28 comprises an aperture 39 at one end and an abutment 40 at the other end. The abutment 40 is integrally molded with the latch member 28 so as to form a one-piece unitary molded structure. The abutment 40 is perpendicular to the length of the latch member 28. An ring 38 with an opening 41 is molded with the side wall 5*a* adjacent to rib 21*e* for receiving a fastener 42. The fastener 42 is then inserted through the aperture 39 and inside the opening 41, pivotally fastening the latch member 28 to the side wall 5*a*. To latch the latch member 28 to side wall 5*b*, the abutment 40 is inserted into a hole 43 (partially obstructed from view) formed in rib 21*b*.

In the embodiment shown in FIG. 23, the latch member 28 is made of plastic. The use of plastic is not intended to be limiting, and the latch member 28 may be made of metal or any other suitable material or combination thereof as is well known in the art.

In another aspect of embodiment shown in FIG. 23, the folding sawhorse 1 is in a storage position. Legs 9*a* are 9*b* are partially nested within one another. Legs 9*c* and 9*d* are also partially nested within one another. The leg pair 9*a*, 9*b* connected to first side 26 are disposed parallel to the leg pair 9*c*, 9*d* connected to the second side 27 of the folding sawhorse 1. Leg pair 9*a*, 9*b* is pivoted relative to pivot axis Y (shown in FIGS. 8 and 9) toward side wall 5*a*. Similarly, leg pair 9*c*, 9*d* is pivoted relative to pivot axis Y (shown in FIGS. 8 and 9) toward side wall 5*b*. The pivoting of leg pair 9*a*, 9*b* toward side wall 5*a* and leg pair 9*c*, 9*d* toward side wall 5*b* allows for angled storage position for legs 9*a*, 9*b*, 9*c*, and 9*d*. The hypotenuse 69*a* (shown in FIG. 11) of inner ramp 30*a* (shown in FIG. 11) operates to guide the legs 9*a*, 9*b* to have an angled orientation relative to a central longitudinal axis of the body 2 when in the storage position to enable leg pair 9*a*, 9*b* connected to first side 26 of the folding sawhorse 1 to be positioned in a side-by-side relationship to leg pair 9*c*, 9*d* connected to second side 27 of the folding sawhorse 1 when in the storage position. Similarly, another hypotenuse (not shown) of another inner ramp (not shown) on second side 27 operates to guide the legs 9*c*, 9*d* to have an angled orientation relative to a central longitudinal axis of the body 2 when in the storage position to enable leg pair 9*c*, 9*d* connected to second side 27 of the folding sawhorse 1 to be positioned in a side-by-side relationship to leg pair 9*a*, 9*b* connected to first side 26 of the folding sawhorse 1 when in the storage position. The angled orientation of legs 9*a*, 9*b*, 9*c*, and 9*d* enable both leg pair 9*a*, 9*b* and leg pair 9*c*, 9*d* to be compactly stored inside the storage compartment 7.

Figure 24:
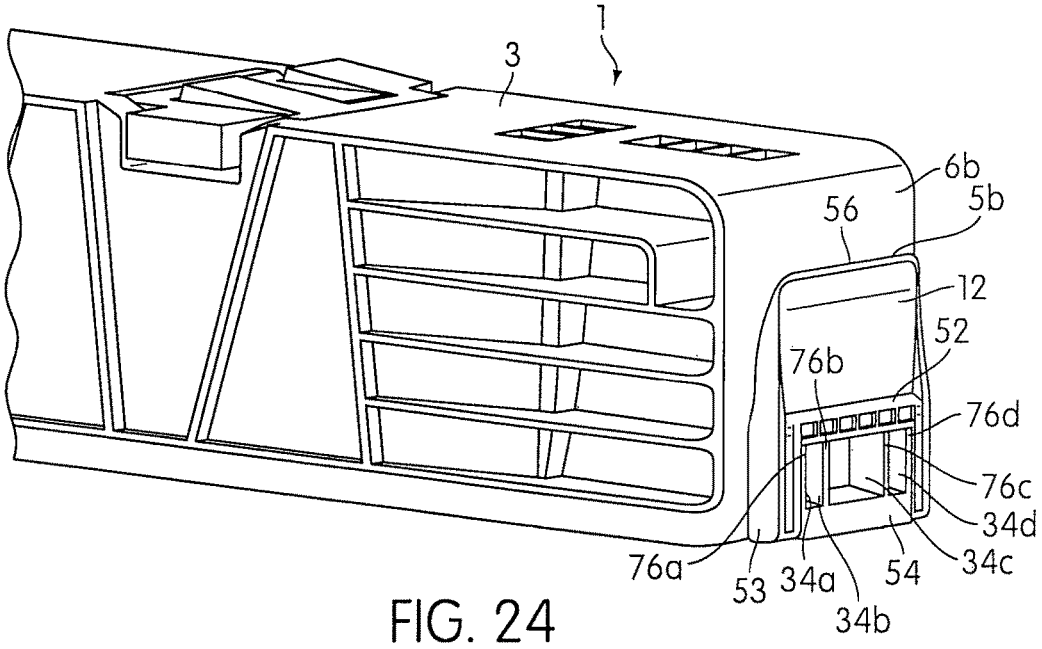
FIG. 24 is a partial perspective view of the folding sawhorse with a connecting latch held in a position along the side wall.
Figure 25:
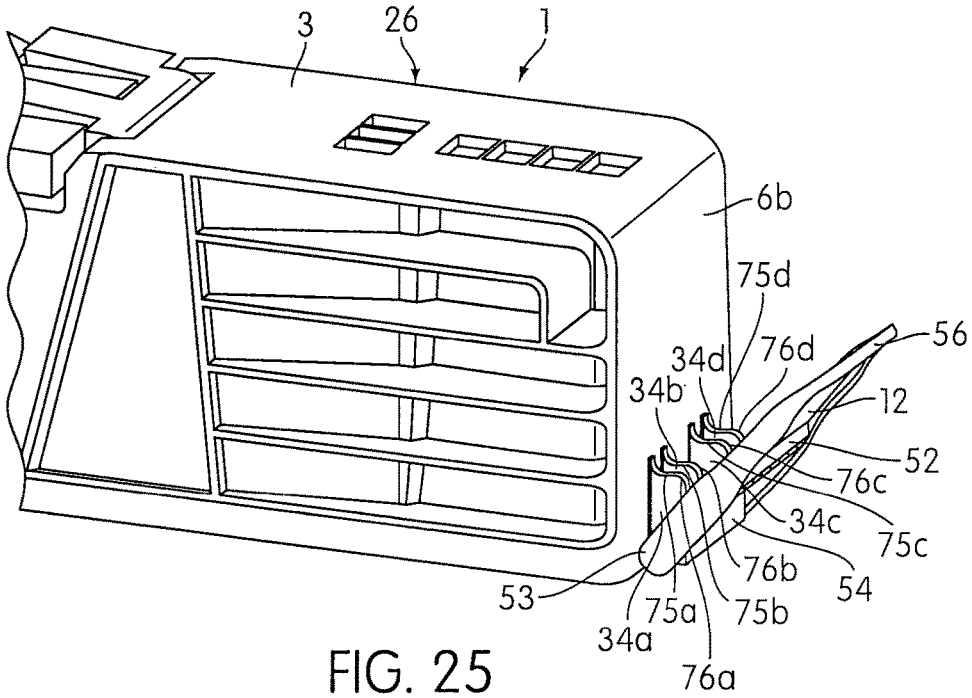
FIG. 25 is a partial perspective view of the folding sawhorse with the connecting latch pivoted away from the side wall.
Figure 26:
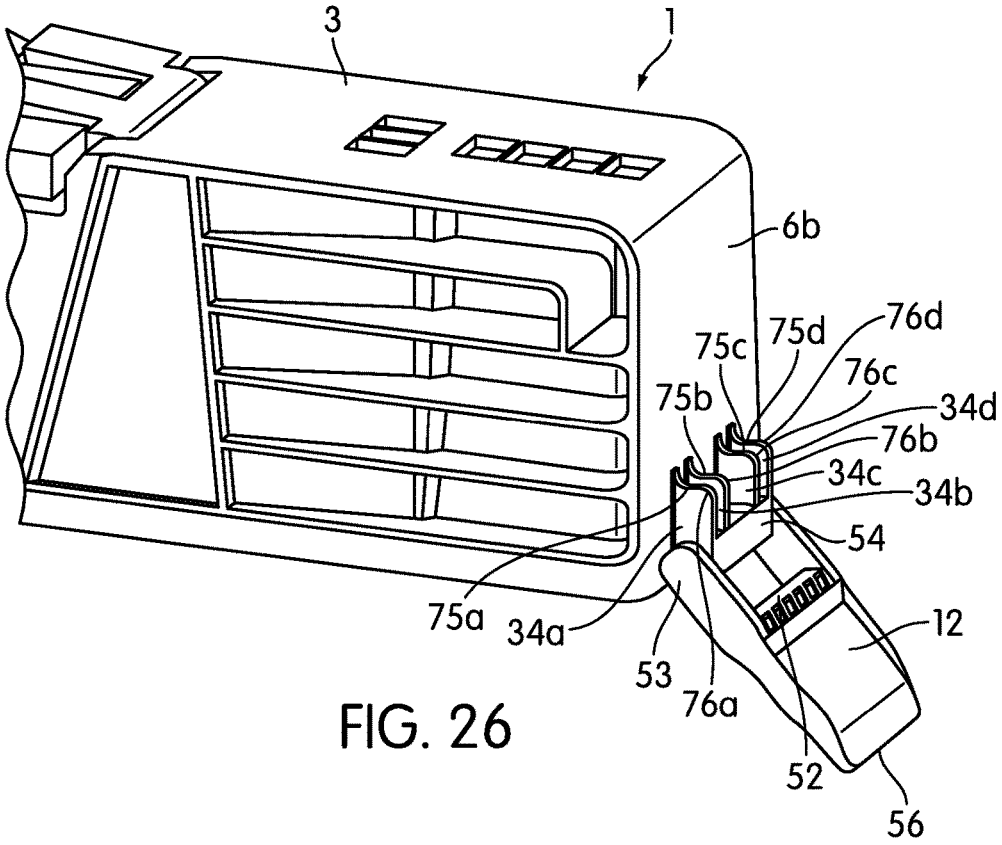
FIG. 26 is a partial perspective view of the folding sawhorse with the connecting latch further pivoted away from the side wall.

In the embodiment shown in FIGS. 24, 25, and 26, the leg pair 9*a* and 9*b* and leg pair 9*c* and 9*d* are in a storage position. A connecting latch 12 is connected relative to side wall 6*b*. The connecting latch 12 comprises a latching portion 52, pivoting rod 53 (obstructed from view by latch retaining protrusion 54), and a handle 56. The connecting latch 12 enables the folding sawhorse 1 to be latched to another folding sawhorse 1' (shown in FIGS. 27, 28, and 29). A latch retaining protrusion 54 is molded with side wall 6*b*. The latch retaining protrusion 54 further comprises a recess or optionally a protrusion configured to pivotally connect with pivoting rod 53 so that connecting latch 12 is pivotally disposed relative to side wall 6*b*.

In another aspect of the embodiment shown in FIGS. 24, 25, and 26, latch retaining abutments 34*a*, 34*b*, 34*c*, and 34*d* (collectively 34) are molded into the outer surface of the side wall 6*b*. Latch retaining abutments 34*a*, 34*b*, 34*c*, and 34*d* are essentially identical. Each latch retaining abutment has lower surfaces 75*a*, 75*b*, 75*c* and 75*d* (collectively 75) (shown in FIGS. 25 and 26), respectively, and upper surfaces 76*a*, 76*b*, 76*c* and 76*d* (collectively 76), respectively. The lower surfaces 75 are curved surfaces configured for receiving latching portion 52. The upper surfaces 76 are curved surfaces on latch retaining abutments 34 that are a larger distance away from side wall 6*b* than the distance between lower surfaces 75 and side wall 6*b*. Lower surfaces 75 are concave (curved inwardly), while upper surfaces 76 are convex (curved outwardly). The latching portion 52 must first contact upper surfaces 76 when latching portion 52 is forcibly engaged with the latch retaining abutments 34.

Figure 27:
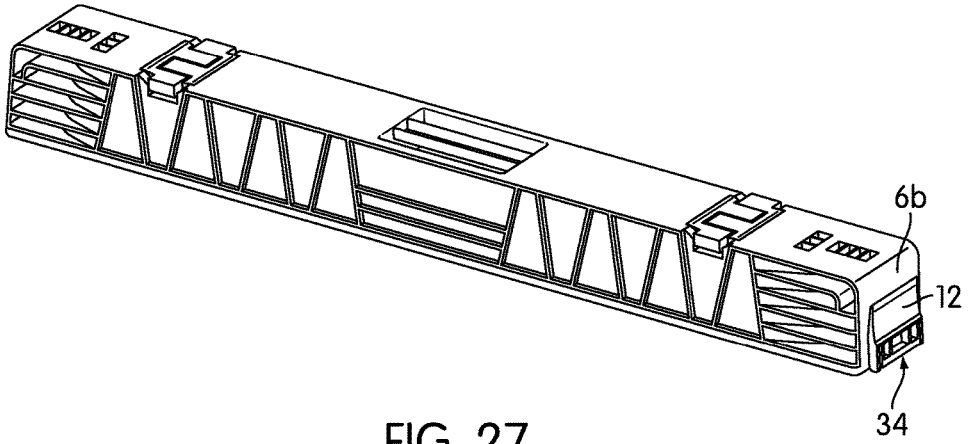
FIG. 27 is a perspective view of the folding sawhorse showing the connecting latch.

In another aspect of the embodiment shown in FIGS. 24, 25, and 26, the width dimension between latching portion 52 and pivoting rod 53 is slightly less than the width dimension between pivoting rod 53 and upper surfaces 76. To hold the connecting latch 12 against side wall 6*b*, latching portion 52 is forcibly engaged with the upper surfaces 76 of leg retaining abutments 34. Because the connecting latch 12 and leg retaining abutments 34 are both made of resilient flexible plastic material, the forcible engagement between the connecting latch 12 and the leg retaining abutments 34 displaces the latching portion 52 and upper surfaces 76, allowing the latching portion 53 to contact lower surfaces 75. The contact between latching portion 52 and lower surfaces 75 frictionally holds connecting latch 12 along side wall 6*b* (as shown in FIG. 27). Each latch retaining abutment 34*a*, 34*b*, 34*c*, and 34*d* provides an incremental amount of frictional force for holding connecting latch 12 against side wall 6*b*. Essentially, the configuration described is a "snap fit" configuration where the latching portion 52 "snap fits" with leg retaining abutments 34. This configuration prevents the connecting latch 12 from swinging freely (shown in FIGS. 29 and 30) when connecting latch 12 is riot in use.

In the embodiment shown in FIG. 27, the connecting latch 12 is held along side wall 6*b* by leg retaining abutments 34.

Figure 28:
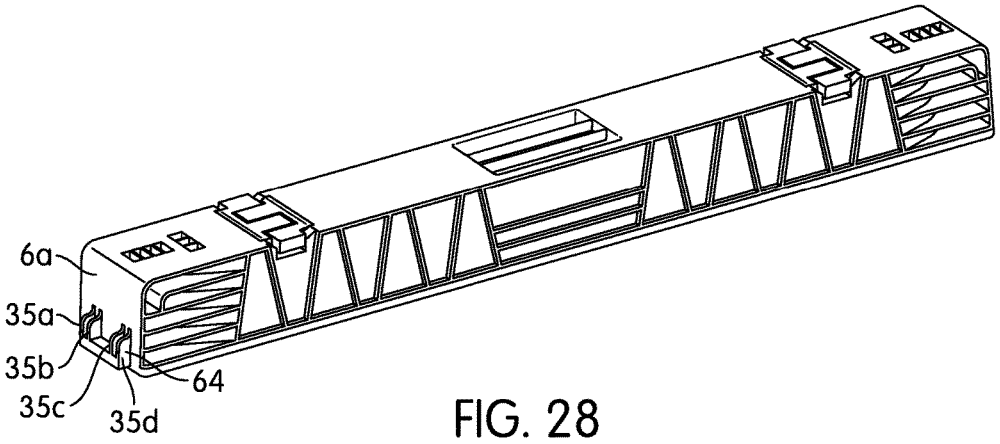
FIG. 28 is a perspective view of the folding sawhorse showing the latch receiving abutments.

In the embodiment shown in FIG. 28, side wall 6*a* has latch receiving protrusion 64 having latch receiving abutments 35*a*, 35*b*, 35*c*, and 35*d* (collectively referred to as 35) molded into the outer surface of side wall 6*a*. Latch receiving protrusion 64 and latch receiving abutments 35 are essentially identical to latch retaining protrusion 54 (shown in FIGS. 22, 23 and 24) and latch retaining abutments 34 (shown in FIGS. 22, 23 and 24), respectively. The only difference between latch receiving protrusion 64 and latch retaining protrusion 54 is that latch retaining protrusion 54 carries connecting latch 12. Because latch receiving abutments 35 are essentially identical to latch retaining abutments, latch receiving abutments 35 essentially operate identically to latch retaining abutments 34 to receive a connecting latch 12' (shown in FIGS. 29 and 30) of another folding sawhorse 1' (shown in FIGS. 29 and 30).

Figure 29:
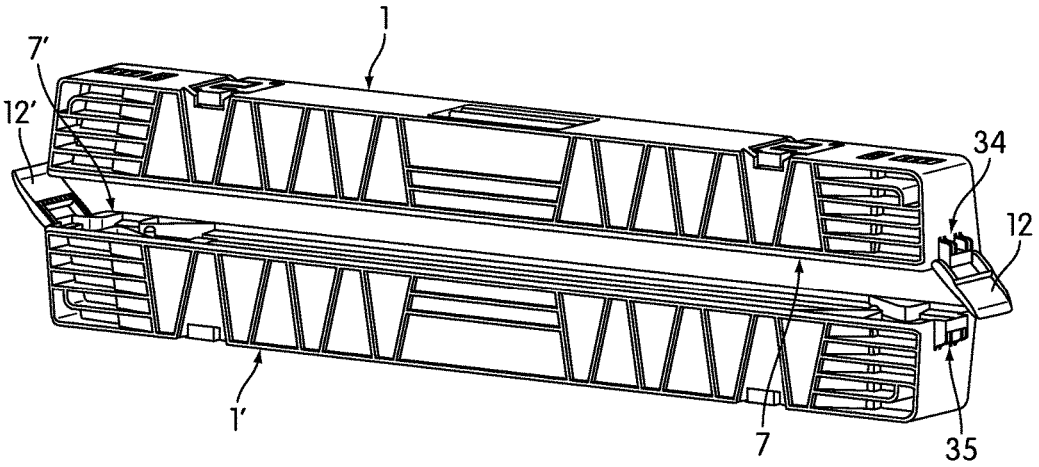
FIG. 29 is a perspective view of one folding sawhorse above another folding sawhorse.
Figure 30:
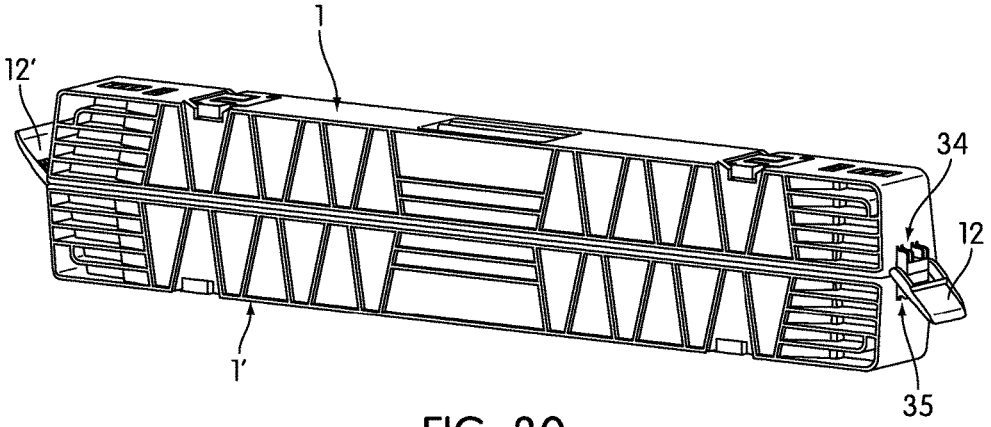
FIG. 30 is a perspective view of one folding sawhorse aligned on top of another folding sawhorse.
Figure 31:
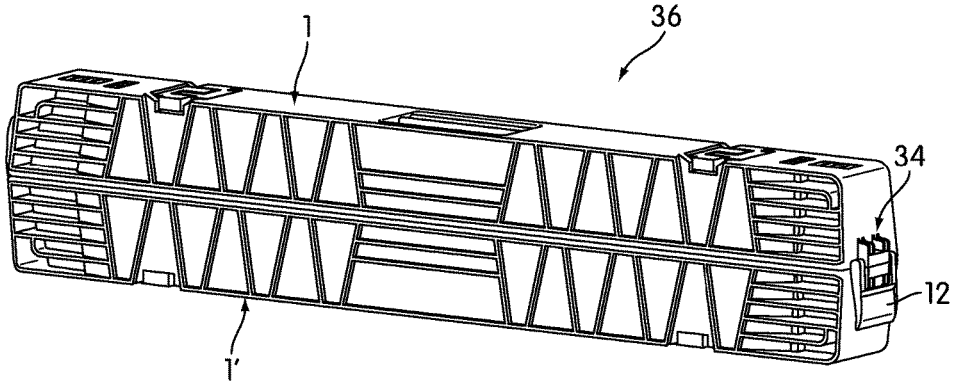
FIG. 31 is a perspective view of two folding sawhorses latched together, forming a twin pack configuration.

In the embodiment shown in FIGS. 29, 30, and 31, folding sawhorse 1 is placed on top of folding sawhorse 1' such that the storage compartment 7 of folding sawhorse 1 faces the storage compartment 7' of folding sawhorse 1'. Furthermore, the folding sawhorses 1 and 1' are aligned such that connecting latch 12 on folding sawhorse 1 can be latched to latch receiving abutments 35 on folding sawhorse 1'; The connecting latch 12 of folding sawhorse 1 is then latched to the latch receiving abutments 35 of folding sawhorse 1', and vice versa for folding sawhorse 1'. When latched together, the two folding sawhorses 1 and 1' form a twin pack configuration 36 (as shown in FIG. 31). The twin pack configuration 36 enables both folding sawhorse 1 and 1' to be more easily carried from one place to another.

Figure 32:
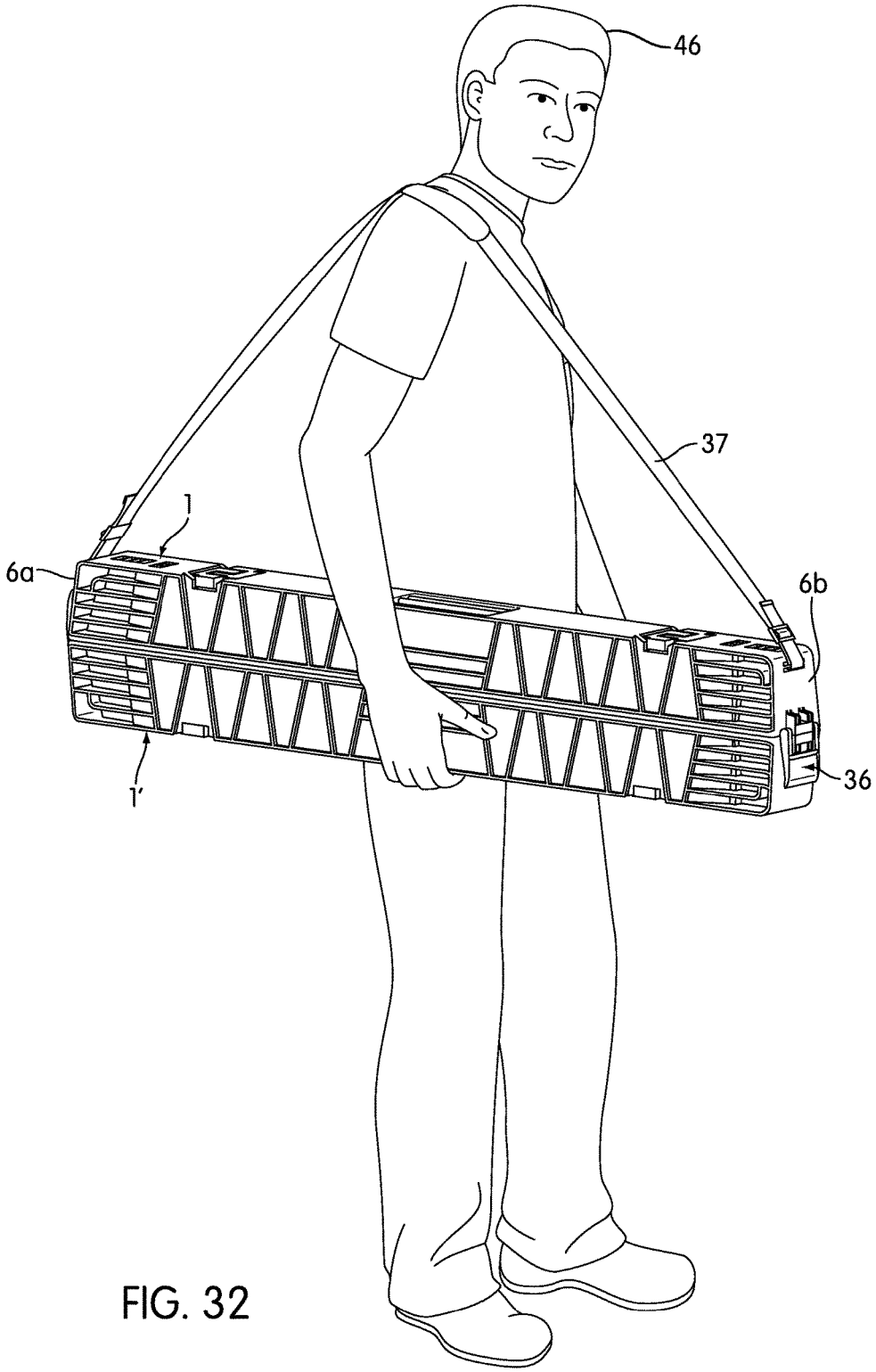
FIG. 32 is a perspective view of a user carrying two sawhorses in a twin pack configuration with a carrying strap.

In the embodiment shown in FIG. 32, a carrying strap 37 is attached to side walls 6*a* and 6*b* of the twin pack configuration 36 of folding sawhorses 1 and 1'. The carrying strap 37 may be adjustable. A user 46 can then carry the twin pack configuration 36 from one place to another.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

What is claimed is:

1. A folding sawhorse comprising:

an elongate body having a top wall with an upper work surface, and a plurality of side walls defining a storage compartment, the elongate body having a central longitudinal axis;

a plurality of leg pairs movable between a deployed position in which the leg pairs are extended away from the elongate body and configured to support the elongate body in a condition for use, and a storage position in which the leg pairs are folded so as to be substantially disposed within the storage compartment, an inner rod molded into the elongate body and defining a first pivot axis relative to the central longitudinal axis; a pivot structure secured substantially within the storage compartment and comprising an integrally formed rod portion and a concave recess portion having a resilient C-shaped clamp, the concave recess portion rotatable about the first pivot axis, the rod portion defining a second pivot axis relative to the central longitudinal axis;

wherein, legs of each one of the plurality of leg pairs are jointly pivotable away from the storage position to an extended position with the concave recess portion rotating about the first pivot axis, and one leg of each one of the plurality of leg pairs is separately pivotable away from the other leg of each of the leg pairs about the second pivot axis to the deployed position, wherein the first pivot axis is substantially perpendicular to the central longitudinal axis and the second pivot axis, and the second pivot axis is configured to pivot between positions parallel and perpendicular with respect to the central longitudinal axis.

2. The folding sawhorse according to claim 1, further comprising a support rail, connected between the legs of each one of the plurality of leg pairs, the support rail comprising two portions, wherein the two portions of the support rail are pivotally disposed relative to each other, and wherein each portion of the support rail is pivotally disposed relative to one of the legs of each one of the plurality of leg pairs.

3. The folding sawhorse according to claim 2, wherein each portion comprises ring portions at one end.

4. The folding sawhorse according to claim 3, wherein each portion further comprises first and second stop surfaces.

5. The folding sawhorse according to claim 4, wherein the first and second stop surfaces contact each other when the support rail is in a straight position.

6. The folding sawhorse according to claim 5, wherein the first and second stop surfaces stop the ring portions from pivoting away from the elongate body unless a force applied to the support rail exceeds a threshold level.

7. The folding sawhorse according to claim 6, wherein the threshold level is greater than a force required to pivot or move the ring portions toward the elongate body.

8. The folding sawhorse according to claim 1, further comprising a leg latch configured to prevent the legs of each one of the plurality of leg pairs from being moved from the storage position to the deployed position, wherein the leg latch is pivotally disposed relative to one of the plurality of side walls of the elongate body.

9. The folding sawhorse according to claim 1, further comprising a connecting latch that enables the sawhorse to be latched to another folding sawhorse.

10. The folding sawhorse according to claim 9, wherein the connecting latch further comprises a latch portion, a pivot rod, and a handle.

11. The folding sawhorse according to claim 10, further comprising a latch retainer protrusion.

12. The folding sawhorse according to claim 11, wherein the latch retainer protrusion further comprises a recess or a protrusion configured to pivotally connect with the pivot rod.

13. The folding sawhorse according to claim 12, wherein abutments are molded into an outer surface of one of the plurality of sidewalls.

14. The folding sawhorse according to claim 13, wherein each abutment has lower surfaces and upper surfaces.

15. The folding sawhorse according to claim 14, wherein the lower surfaces are curved surfaces configured for receiving the latch portion.

16. The folding sawhorse according to claim 15, wherein the latch portion first contacts upper surfaces when the latch portion is forcibly engaged with the abutments.

17. The folding sawhorse according to claim 1, wherein the first pivot axis extends along the inner rod that extends perpendicular to the central longitudinal axis of the elongate body when the leg pairs are in the deployed position and the storage position, wherein the inner rod forming part of the elongate body, and wherein the concave recess portion of the pivot structure is pivotally attached to the inner rod, providing the first pivot axis.

18. The folding sawhorse according to claim 1, wherein the rod portion of the pivot structure is inserted through a through-hole formed in each one of the plurality of leg pairs, providing the second pivot axis for each one of the plurality of leg pairs.

19. The folding sawhorse according to claim 1, wherein the elongate body comprises inwardly extending projections, and wherein the projections define a passage, the passage is configured to allow the legs of each one of the plurality of leg pairs to pass therethrough.

20. The folding sawhorse according to claim 19, wherein, the sawhorse is configured so that after the leg pairs pass through the corresponding passage, the leg pairs can be separated to the deployed position behind the projections, wherein the leg pairs forcibly engage with adjacent surfaces of the elongate body when the leg pairs are in the deployed position so that material of the elongate body retains the leg pairs in the deployed position.

21. The folding sawhorse according to claim 20, wherein the inwardly extending projections are constructed and arranged to extend inwardly from the sidewalls.

22. The folding sawhorse according to claim 20, wherein the inwardly extending projections are constructed and arranged to guide a leg of said leg pairs to have an angled orientation relative to the central longitudinal axis of the elongate body when the leg pair is in the storage position to enable the leg pair connected to one side of the sawhorse to be positioned in side-by-side relationship to another leg pair of said leg pairs connected to an opposite side of the sawhorse when both the leg pairs are in the storage positions.

23. The folding sawhorse according to claim 22, wherein when in the storage position, the leg pair connected to the one side of the sawhorse is disposed parallel to the leg pair connected to the opposite side of the sawhorse.

24. The folding sawhorse according to claim 23, wherein, when in the storage position, the legs of the leg pair connected to one side of the sawhorse are at least partially nested within one another, and the legs of the leg pair connected to the opposite side of the sawhorse are at least partially nested within one another.

25. The folding sawhorse according to claim 24, wherein the elongate body has ribs integrally molded with inner surfaces of the side walls.

26. The folding sawhorse according to claim 25, wherein, when in the storage position, both the leg pairs forcibly engage the ribs, displacing material of the ribs, so that each of the leg pairs remain in the storage position.

27. The folding sawhorse according to claim 1, further comprising a handle portion disposed within a recessed opening in the top wall, wherein the legs of each one of the plurality of leg pairs and the handle portion are disposed in substantially overlying relationship with one another, when the legs are in a storage position in which the legs of each one of the plurality of leg pairs are folded so as to be substantially disposed within the storage compartment.

28. The folding sawhorse according to claim 27, wherein the handle portion is located at a position substantially centered between the side walls.

29. The folding sawhorse according to claim 28, wherein a top surface of the handle portion lies in a same plane as that of the work surface of the top wall.

30. The folding sawhorse according to claim 29, wherein the handle portion includes an elongated structure spanning the recessed opening, and wherein the handle portion is constructed and arranged not to project above the work surface.

31. The folding sawhorse according to claim 30, wherein the top surface of the handle portion is configured to function as part of the work surface.

32. The folding sawhorse according to claim 1, further comprising a latch member pivotally connected with one of the side walls and latchable to an opposite of the side walls to lock the legs of each one of the plurality of leg pairs in the storage position.

33. The folding sawhorse according to claim 32, wherein the latch member comprises an aperture at one end of the latch member and an abutment integrally molded with the latch member at another end of the latch member.

34. The folding sawhorse according to claim 33, wherein the abutment is perpendicular to a length of the latch member.

35. The folding sawhorse according to claim 34, wherein the latch member is pivotally connected to one of the side walls by a fastener.

36. The folding sawhorse according to claim 35, wherein one of the side walls further comprises an integrally molded rib.

37. The folding sawhorse according to claim 36, wherein a hole is formed in the rib.

38. The folding sawhorse according to claim 37, wherein the hole is configured to receive the abutment.

39. The folding sawhorse according to claim 38, wherein the abutment of the latch member is inserted into the hole formed in the rib integrally molded into one of the side walls.

40. The folding sawhorse according to claim 1, wherein the plurality of leg pairs are made of a metal material.

41. The folding sawhorse according to claim 1, wherein pivoting of the concave recess causes simultaneous movement of the rod portion to a position substantially extending along the central longitudinal axis.

42. A folding sawhorse comprising:

an elongate body having a top wall with an upper work surface, and a plurality of side walls defining a storage compartment, the elongate body having a central longitudinal axis;

a plurality of leg pairs including a first leg pair pivotally mounted towards a first side the elongate body and a second leg pair pivotally mounted towards a second side of the elongate body;

the first leg pair and the second leg pair being movable between a deployed position in which the first leg pair and the second leg pair leg pair are extended away from the elongate body and configured to support the elongate body in a condition for use, and a storage position in which the first leg pair and the second leg pair are folded so as to be substantially disposed within the storage compartment, an inner rod molded into the elongate body and defining a first pivot axis relative to the central longitudinal axis;

a pivot structure secured substantially within the storage compartment and comprising an integrally formed rod portion and a concave recess portion having a resilient C-shaped clamp, the concave recess portion rotatable about the first pivot axis, the rod portion defining a second pivot axis relative to the central longitudinal axis;

wherein, legs of each one of the first leg pair and the second leg pair are jointly pivotable away from the storage position to an extended position with the concave recess portion rotating about the first pivot axis, and one leg of each one of the first leg pair and the second leg pair is separately pivotable away from the other leg of each of the first leg pair and the second leg pair about the second pivot axis to the deployed position, wherein the first pivot axis is substantially perpendicular to the central longitudinal axis and the second pivot axis, and wherein the second pivot axis is configured to pivot between positions parallel and perpendicular with respect to the central longitudinal axis.

43. The folding sawhorse according to claim 42, wherein the first pivot axis extends along the inner rod that extends perpendicular to the central longitudinal axis of the elongate body when the first leg pair and the second leg pair are in the deployed position and the storage position, and wherein the rod portion forms part of the pivot structure and the inner rod forms part of the elongate body, wherein the inner rod is molded into an inner side of the top wall of the elongate body.

44. The folding sawhorse according to claim 43, wherein the concave recess portion of the single pivot structure is pivotally attached to the inner rod, providing the first pivot axis.

45. The folding sawhorse according to claim 44, wherein the first and second leg pairs are configured to pivot relative to the second pivot axis inside the storage compartment so that, when the first and second leg pairs are in the storage position, the first and second leg pairs are in an angled orientation relative to the central longitudinal axis of the elongate body.

46. The folding sawhorse according to claim 42, wherein the rod portion of the pivot structure is inserted through a through-hole formed in each of the first and second leg pairs, providing the second pivot axis for each of the first and second leg pairs.

47. The folding sawhorse according to claim 42, wherein the elongate body comprises inwardly extending projections, and wherein the projections define a first passage and a second passage through which the first leg pair and the second leg pair, respectively, are configured to pass such that after the first and second leg pairs pass through their corresponding passages, the legs of the first and second leg pairs can be separated to the deployed position behind the projections.

48. The folding sawhorse according to claim 42, wherein the first leg pair and the second leg pair are made of a metal material.

49. The folding sawhorse according to claim 42, wherein pivoting of the concave recess causes simultaneous movement of the rod portion to a position substantially extending along the central longitudinal axis.

* * * * *